US008159137B2

(12) United States Patent
Kuwahara et al.

(10) Patent No.: US 8,159,137 B2
(45) Date of Patent: Apr. 17, 2012

(54) MAGNETRON

(75) Inventors: Nagisa Kuwahara, Tochigi (JP); Takeshi Ishii, Tochigi (JP); Masayuki Aiga, Hyogo (JP)

(73) Assignee: Panasonic Corporation, Osaka (JP)

( * ) Notice: Subject to any disclaimer, the term of this patent is extended or adjusted under 35 U.S.C. 154(b) by 572 days.

(21) Appl. No.: 11/727,460

(22) Filed: Mar. 27, 2007

(65) Prior Publication Data

US 2007/0273287 A1 Nov. 29, 2007

(30) Foreign Application Priority Data

| | | |
|---|---|---|
| Mar. 27, 2006 | (JP) | P. 2006-084599 |
| Jul. 25, 2006 | (JP) | P. 2006-201584 |
| Jul. 31, 2006 | (JP) | P. 2006-207532 |
| Oct. 27, 2006 | (JP) | P. 2006-292144 |

(51) Int. Cl.
*H01J 25/50* (2006.01)

(52) U.S. Cl. ..... 315/39.51; 315/39.71

(58) Field of Classification Search ..... 315/5.35, 315/39.51, 39.71, 501
See application file for complete search history.

(56) References Cited

U.S. PATENT DOCUMENTS

| | | | | |
|---|---|---|---|---|
| 4,223,246 A | | 9/1980 | Osepchuk | |
| 4,233,540 A | * | 11/1980 | Tashiro et al. | 315/39.51 |
| 4,742,272 A | | 5/1988 | Kusano et al. | |
| 5,635,798 A | * | 6/1997 | Ogura et al. | 315/39.71 |
| 5,798,613 A | | 8/1998 | Lee | |

FOREIGN PATENT DOCUMENTS

| | | |
|---|---|---|
| EP | 0 327 116 A1 | 8/1989 |
| JP | 63-003417 | 1/1988 |
| JP | 04-077412 | 3/1992 |
| JP | 2006-049119 | 2/2006 |

OTHER PUBLICATIONS

European Search Report, with written opinion, issued in European Patent Application No. EP 07104880.5-2208/1840933 dated on Nov. 3, 2008.

* cited by examiner

*Primary Examiner* — Douglas W Owens
*Assistant Examiner* — Jianzi Chen
(74) *Attorney, Agent, or Firm* — McDermott Will & Emery LLP

(57) ABSTRACT

To provide a magnetron capable of reducing noises in a low frequency band of 30 MHz or less without deteriorating the stability of a load depending on phases, and also ensuring the precision of assembly dimensions without increasing the number of components, a coiled filament 3 is arranged between an input-side end hat 61 and an output-side end hat 7 which are supported by a cathode supporting rod 8. A larger-diameter boss 61*a* in the end hat 61 extends to the interior of an interaction space, a smaller-diameter boss 61*b* and one end 3*a* of the filament 3 are secured to each other, and the other end 3*b* is secured to a boss 7*a* of the end hat 7. Here, the dimension of an axial free length part F which forms an electron emission part which is not secured to the end hats 61 and 7 of the filament 3 is set to 50% or more and 80% or less of the axial dimension H of plate-like vanes 2, and the electron emission part is arranged so as to be displaced to the output side.

18 Claims, 20 Drawing Sheets

MAGNETRON

BACKGROUND OF THE INVENTION

1. Field of the Invention

The present invention relates to a magnetron which is used for apparatuses utilizing high frequencies, and which is intended to reduce noises.

2. Description of the Related Art

A conventional magnetron will be described with reference to drawings.

FIG. 32 is a longitudinal sectional view showing an interaction space in which electrons of a magnetron in a conventional article make motions. In this magnetron, a plurality of plate-like vanes 2 (only two vanes are shown in this drawing) are radially arranged inside an anode tube 1, and the plate-like vanes 2 are alternately connected by pressure equalizing rings 9, 10, 11, and 12. By alternately connecting the pressure equalizing rings 9, 10, 11, and 12 in this way, the magnetron will oscillate stably in a $\pi$ mode. Also, a cathode 13 composed of a coiled filament 3, a pair of end hats 6 and 7, and a cathode supporting rod 8 is provided along an axial center of the anode tube 1. This filament 3 is formed of tungsten containing thorium of 1 to 2%, and is designed such that a work function is lowered and electrons are emitted easily by carburizing the surface of the filament. Furthermore, the pair of end hats 6 and 7 are arranged at both ends of the filament 3 in an axial direction in order to suppress leakage of electrons in the axial direction, and are secured to ends 3*a* and 3*b* of the filament 3. Here, since the ends 3*a* and 3*b* of the filament 3 which are secured to the end hats 6 and 7 are not carburized, they have a high work function and hardly emit electrons. Actually, an electron emission part which emits electrons is an axial free length region of the filament 3 which is carburized and is not secured to the end hats 6 and 7.

In such a magnetron, a technique of reducing the noises generated in the magnetron is suggested conventionally (for example, refer to Patent Document 1 and Patent Document 2).

FIG. 33 is a longitudinal sectional view showing a portion within an anode tube of a magnetron disclosed in the above Patent Document 1. In this magnetron, in addition to the components of FIG. 32, metallic cylindrical bodies 4 and 5 are arranged at both ends of the cathode 13. The input-side cylindrical body 4 of the cathode 13 is secured to the input-side end hat 6, and the output-side cylindrical body 5 of the cathode 13 is secured to the output-side end hat 7. Since these cylindrical bodies 4 and 5 suppress spread of the electrons emitted from the filament 3 and the magnetron is equipped with these cylindrical bodies 4 and 5, noises in a band of 30 MHZ to 200 MHz can be reduced remarkably.

In addition, FIG. 34 is a waveform chart showing noise levels of 1 GHz or less in a conventional article in which the cylindrical bodies 4 and 5 shown in FIG. 32 are not provided at all, which is actually measured by the inventors of the present application. It can be surely understood that, in the conventional article in which the cylindrical bodies are not provided at all, noises are especially high below 200 MHz, and in this respect, a reduction in noises in a band of 30 MHz to 200 MHz as described in Patent Document 1 is meaningful.

It is also is known that noises are reduced by suppressing excess electrons within an interaction space. According to a technique described in Patent Document 2, the amount of emission of electrons is suppressed and thereby noises are reduced, by setting the ratio P/d of the wire diameter d and pitch P of a filament to 2.5 or more and 3.5 or less.

Patent Document 1: JP-A4-77412

Patent Document 2: JP-A63-3417

Generally, electrons of a magnetron orbits a cathode while circling it by a force caused by an electrostatic field to which the electrons emitted from an electron emission part of the cathode are applied between the cathode and an anode, and the Lorentz force caused by a magneto-static field which is applied in the axial direction. Also, the electrons are hunted by the natural vibration of a plurality of resonators formed by plate-like vanes, an anode tube, and pressure equalizing rings, thereby forming an electron flux. Then, an induced current flows into the plate-like vanes by rotation of this electron flux, and is then converted into microwave energy by resonance of the vanes.

The shape of this electron flux depends on the intensity of a microwave electric field determined by a load combined with the magnetron, and has great influence on an oscillation frequency. Furthermore, if the intensity of the microwave electric field is strong, and the electron flux is formed into a sharp shape under the influence of the intensity, the level of noises will rise by the interaction of the crammed electrons. FIG. 36 shows noise levels when phases are changed.

It is also believed that the noises which propagate through a power line, and the noises emitted into a space are mainly generated at axial ends of an interaction space in which distortion is caused in an electric field or a magnetic field, and thus an orthogonal electromagnetic field is not maintained.

In view of the facts, in the technique disclosed in Patent Document 1, the cylindrical bodies are provided so that the electrons emitted in the axial ends of the tube cannot make motions.

Meanwhile, in the technique disclosed in Patent Document 1, noises in a band of 30 MHz to 200 MHz can be reduced, but attention is not paid to a band of 30 MHz or less in which it is difficult to suppress noises with a noise filter (not shown), composed of a coil, a capacitor, etc., which is attached to a conventional magnetron. Also, the experiments which were conducted by the inventors of the present application on the basis of the technique disclosed in Patent Document 1 show that the distribution of an electrostatic field in the interaction space may vary due to the arrangement of the cylindrical bodies 4 and 5 in the interaction space, and thus the stability of a load depending on phases tends to deteriorate significantly. Moreover, the technique disclosed in the above Patent Document 1 has a problem in that, since the cylindrical bodies 4 and 6 are secured to the end hats 6 and 7, but they are components separate from the end hats 6 and 7, respectively, the number of components is increased and the precision of assembly dimensions are not ensured easily.

Also, as shown in FIG. 37, the inventors of the present application have found out through experiments that many of noises are generated in a small current region where an anode current is about 400 mA or less. This is believed that, since the electron emission amount are set so that a peak current can be secured in, for example, non-smooth driving of half-wave voltage doubler power sources as being used for microwave ovens, electrons becomes excessive in the small current region, and consequently, noises are generated due to interaction of the excessive electrons.

Although the effect of reducing a noise of 1 MHz or less is described in the technique shown in Patent Document 2, attention is not paid to the relationship with a peak anode current value. As shown in FIG. 38, it can also be confirmed from the experiments which were conducted by the inventors of the present application on the basis of the technique disclosed in Patent Document 2 that a noise-reducing effect can be confirmed in a region where an average anode current value is 100 mA or less, but a noise-reducing effect is hardly shown in an anode current region of 200 mA and 300 mA. It is believed that this is because the electron emission amount was set so that a peak current could be ensured, and therefore electrons became excessive in the small current region.

SUMMARY OF THE INVENTION

The present invention has been made in view of the above knowledge in order to solve the aforementioned problems. It is therefore an object of the invention to provide a magnetron capable of reducing noises in a low frequency band of 1 GHz or less, especially 30 MHz less without deteriorating the stability of a load depending on phases, and also ensuring the precision of assembly dimension, without increasing the number of components.

The above object is achieved by the following configurations.

(1) A magnetron of the present invention includes a cylindrical anode tube in which a plurality of plate-like vanes are radially disposed toward a central axis, a cathode disposed on the central axis of the anode tube by a cathode supporting rod, and a pair of end hats provided in positions on the cathode supporting rod to sandwich the cathode in the axial direction. Here, an electron emission part of the cathode is arranged so as to be displaced in the axial direction.

(2) In the magnetron of the above (1), preferably, the dimension of a portion of the electron emission part which faces the plate-like vanes is 50% or more and 80% or less of the axial dimension of the plate-like vanes.

(2) In the magnetron of the above (1), preferably, the electron emission part is disposed so as to be displaced to the output side.

(4) A high-frequency utilizing apparatus includes the magnetron according to any one of the above (1) to (3).

(5) A magnetron of the present invention includes a cylindrical anode tube in which a plurality of plate-like vanes are radially disposed toward a central axis, a cathode disposed on the central axis of the anode tube by a cathode supporting rod, and a pair of end hats provided in positions on the cathode supporting rod to sandwich the cathode in the axial direction. Here, an electron emission part of the cathode is arranged so as to be displaced in the axial direction, and the axial magnetic field intensity in a position in the vicinity of the plate-like vanes which face the electron emission part is made almost uniform.

(6) In the magnetron described in the above (5), it is preferable that, when a maximum value and a minimum value of the axial magnetic field intensity in the vicinity of the plate-like vanes which face the electron emission part are defined as (Bmax) and (Bmin), respectively, the ratio (Bmin)/(Bmax) is 0.9 to 1.0.

(7) In the magnetron described in the above (5) or (6), the shapes of a pair of pole pieces disposed on both opening ends of the anode tube may be made different from each other in order to form the axial magnetic field intensity.

(8) In the magnetron described in the above (5), of through holes formed in the centers of smaller-diameter flat parts of the pole pieces, a through hole on the side of the electron emission part of the cathode that is displaced in the axial direction may be made larger.

(9) In the magnetron described in the above (7), the diameter of a smaller-diameter flat part of a pole piece of the pair of pole pieces on the side of the electron emission part of the cathode that is displaced in the axial direction may be made larger.

(10) In the magnetron described in the above (7), the axial height of a pole piece of the pair of pole pieces on the side of the electron emission part of the cathode that is displaced in the axial direction may be made larger.

(11) In the magnetron described in the above (5), the distance between the plate-like vanes, and a pole piece of the pair of pole pieces on the side of the electron emission part of the cathode that is displaced in the axial direction may be made larger.

(12) A high-frequency utilizing apparatus includes the magnetron according to any one of the above (5) to (11).

(13) A magnetron of the present invention includes a cylindrical anode tube in which a plurality of plate-like vanes are radially disposed toward a central axis, a cathode disposed on the central axis of the anode tube by a cathode supporting rod, and a pair of end hats provided in positions on the cathode supporting rod to sandwich the cathode in the axial direction. Here, an electron emission part of the cathode is arranged so as to be displaced in the axial direction, and the electron emission part is formed of a coiled filament the wire diameter of which is $\phi$0.43 mm to $\phi$0.47 mm, and the pitch of which is 0.9 mm or less.

(14) In the magnetron of the above (13), preferably, the dimension of a portion of the electron emission part which faces the plate-like vanes is 50% or more and 80% or less of the axial dimension of the plate-like vanes.

(15) A high-frequency utilizing apparatus includes the magnetron according to any one of the above (13) to (14).

(16) A magnetron of the present invention includes a cylindrical anode tube in which a plurality of plate-like vanes are radially disposed toward a central axis, a cathode disposed on the central axis of the anode tube by a cathode supporting rod, and a pair of end hats provided in positions on the cathode supporting rod to sandwich the cathode in the axial direction. An electron emission part of the cathode is arranged so as to be displaced in the axial direction, the input-side end hat of the pair of end hats is configured such that a boss extends with a reduced diameter towards an interaction space, and a smaller-diameter boss is formed with a step at the tip of the boss, the smaller-diameter boss of the input-side end hat and one end of the filament constituting the cathode are secured to each other, and the other end of the filament is secured to a boss of the output-side end hat.

(17) In the magnetron described in the above (16), the boss of the input-side end hat extends in a tapered shape with a reduced diameter towards the interaction space.

(18) A high-frequency utilizing apparatus includes the magnetron according to any one of the above (16) to (17).

According to such configurations, noises in a low frequency band of 30 MHz or less can be reduced without deteriorating the stability of a load depending on phases, and the precision of assembly dimensions can also be ensured without increasing the number of components.

According to the magnetron described in the above (1), since the carburized filament is arranged so as to be displaced in the axial direction, electrons are not emitted from the portions of the filament of the cathode which do not face the plate-like vanes, and thus unnecessary emission of electrons resulting from noises is suppressed. Moreover, it is believed that the microwave field intensity is strongest at an axial middle part of a resonator, i.e., at axial middle parts of the plate-like vanes. However, since the electron emission part is displaced, the intensity of a microwave electric field in a position where electrons are emitted can be made weaker than a case where the electron emission part is not displaced, and thus the influence on electrons by microwave electric field is lessened. For this reason, noises in a low frequency band of 30 MHz or less can be reduced. Also, since the electron emission part itself is arranged so as to be simply displaced unlike the conventional magnetron in which cylindrical bodies are provided at both ends of the cathode, an increase in the number of components can be prevented, assembling can be performed as before, and the precision of assembly dimensions can be ensured sufficiently. Moreover, since the dimension of the interaction space dimension in which electrons can make motions is not completely different from that of the conventional interaction space, the stability of a load depending on phases does not deteriorate.

According to the magnetron described in the above (2), the electron emission part in the interaction space is set to a range of 50 to 80% of the axial dimension of the plate-like vanes, so that noises in a broad band can be reduced significantly while a decline in the oscillation efficiency of the magnetron is suppressed.

According to the magnetron described in the above (3), the electron emission part is arranged so as to be displaced, whereby the conduction of heat to titanium arranged on a top face of the output-side end hat in order to improve the degree of vacuum is better than that in a case where the electron emission part is displaced to the input side, and a getter effect is exhibited further. Furthermore, noises in a broad band can be reduced significantly.

According to the magnetron described in the above (4), since noises in a frequency band of 30 MHz or less is reduced, the volumes of anti-noise components, such as a coil and a capacitor, can be made small, and cost reduction can be attained by that much.

According to such configurations, noises in a low frequency band of 1 GHz or less can be reduced without deteriorating the stability of a load depending on phases, a decline in oscillation efficiency can be suppressed, and the precision of assembly dimensions can also be ensured without increasing the number of components.

According to the magnetron described in the above (5), since the carburized filament is arranged so as to be displaced in the axial direction, electrons are not emitted from the portions of the filament of the cathode which do not face the plate-like vanes, and thus unnecessary emission of electrons resulting from noises is suppressed. Moreover, it is believed that the microwave field intensity is strongest at an axial middle part of a resonator, i.e., at axial middle parts of the plate-like vanes. However, since the electron emission part is displaced, the intensity of a microwave electric field in a position where electrons are emitted can be made weaker than a case where the electron emission part is not displaced, and thus the influence on electrons by microwave electric field is lessened. Moreover, the axial magnetic field intensity in the vicinity of the plate-like vanes which face the electron emission part are made almost uniform whereby the drift speed of electrons by the action of an electrostatic field and a magnetostatic field is kept almost constant, and the electron flux is converged almost uniformly. For this reason, noises in a low frequency band of 1 GHz or less can be reduced, and a decline in oscillation frequency can be suppressed.

Also, since the electron emission part itself is arranged so as to be simply displaced unlike the conventional magnetron in which cylindrical bodies are provided at both ends of the cathode, an increase in the number of components can be prevented, assembling can be performed as before, and the precision of assembly dimensions can be ensured sufficiently. Moreover, since the dimension of the interaction space dimension in which electrons can make motions is not completely different from that of the conventional interaction space, the stability of a load depending on phases does not deteriorate.

According to the magnetron described in the above (6), the ratio (Bmin)/(Bmax) of a maximum value (Bmax) and a minimum value (Bmin) of the axial magnetic field intensity in the vicinity of the plate-like vanes which face the electron emission part is set to 0.9 to 1.0, so that noises in a broad band can be reduced significantly while a decline in the oscillation efficiency of the magnetron is suppressed.

According to the magnetron described in the above (3), the shapes of a pair of pole pieces disposed on both opening ends of the anode tube are made different from each other, so that the axial magnetic field intensity in the vicinity of the plate-like vanes which face the electron emission part can be made almost uniform, and noises in a broad band can be reduced significantly while a decline in the oscillation efficiency of the magnetron is suppressed.

According to the magnetron described in the above (7), of through holes formed in the centers of smaller-diameter flat parts of the pole pieces, a through hole on the side of the electron emission part of the cathode that is displaced in the axial direction is made larger, so that noises in a broad band can be reduced significantly while a decline in the oscillation efficiency of the magnetron is suppressed.

According to the magnetron described in the above (5), the diameter of a smaller-diameter flat part of a pole piece of the pair of pole pieces on the side of the electron emission part of the cathode that is displaced in the axial direction is made larger, so that noises in a broad band can be reduced significantly while a decline in the oscillation efficiency of the magnetron is suppressed.

According to the magnetron described in the above (8), the axial height of a pole piece of the pair of pole pieces on the side of the electron emission part of the cathode that is displaced in the axial direction is made larger, so that noises in a broad band can be reduced significantly while a decline in the oscillation efficiency of the magnetron is suppressed.

According to the magnetron described in the above (9), the distance between the plate-like vanes, and a pole piece of the pair of pole pieces on the side of the electron emission part of the cathode that is displaced in the axial direction may be made larger, so that the axial magnetic field intensity in the vicinity of the plate-like vanes which face the electron emission part can be made almost uniform, and noises in a broad band can be reduced significantly while a decline in the oscillation efficiency of the magnetron is suppressed.

According to the magnetron described in the above (10), since noises in a frequency band of 1 GHz or less is reduced, the volumes of anti-noise components, such as a coil and a capacitor, can be made small, and cost reduction can be attained by that much.

According to the magnetron described in the above (13), since the carburized filament is arranged so as to be displaced in the axial direction, electrons are not emitted from the portions of the filament of the cathode which do not face the plate-like vanes, and thus unnecessary emission of electrons resulting from noises is suppressed. Moreover, it is believed that the microwave field intensity is strongest at an axial middle part of a resonator, i.e., at axial middle parts of the plate-like vanes. However, since the electron emission part is displaced, the intensity of a microwave electric field in a position where electrons are emitted can be made weaker than a case where the electron emission part is not displaced, and thus the influence on electrons by microwave electric field is lessened. Moreover, the wire diameter and pitch of the filament is kept appropriate in the displaced state. Accordingly, with an electron emission amount required in a region where an anode current is small being set initially, the cathode reverse impact energy that increases with an increase in the amount of the anode current is applied to the whole cathode, and with an increase or decrease in displacement, the filament is appropriately heated whereby a required electron emission amount is ensured even in a large current region. For this reason, noises in a low frequency band of 30 MHz or less can be reduced. Also, since the electron emission part itself is arranged so as to be simply displaced unlike the conventional magnetron in which cylindrical bodies are provided at both ends of the cathode, an increase in the number of components can be prevented, assembling can be performed as before, and the precision of assembly dimensions can be ensured sufficiently. Moreover, since the dimension of the interaction space dimension in which electrons can make motions is not completely different from that of the conventional interaction space, the stability of a load depending on phases does not deteriorate. Also, noises can be reduced in a broad anode current region by combining the displacement of the electron emission part with the appropriate selection of the wire diameter and pitch of the filament.

According to the magnetron described in the above (14), the electron emission part in the interaction space is set to a range of 50 to 80% of the axial dimension of the plate-like vanes, so that noises in a broad band can be reduced significantly while a decline in the oscillation efficiency of the magnetron is suppressed.

According to the magnetron described in the above (15), since noises in a frequency band of 30 MHz or less is reduced, the volumes of anti-noise components, such as a coil and a capacitor, can be made small, and cost reduction can be attained by that much.

According to the magnetron described in the above (16), since the carburized filament is arranged so as to be displaced in the axial direction, electrons are not emitted from the portions of the filament of the cathode which do not face the plate-like vanes, and thus unnecessary emission of electrons resulting from noises is suppressed. Moreover, it is believed that the microwave field intensity is strongest at an axial middle part of a resonator, i.e., at axial middle parts of the plate-like vanes. However, since the electron emission part is displaced, the intensity of a microwave electric field in a position where electrons are emitted can be made weaker than a case where the electron emission part is not displaced, and thus the influence on electrons by microwave electric field is lessened. For this reason, noises in a low frequency band of 30 MHz or less can be reduced. Also, since the electron emission part itself is arranged so as to be simply displaced unlike the conventional magnetron in which cylindrical bodies are provided at both ends of the cathode, an increase in the number of components can be prevented, assembling can be performed as before, and the precision of assembly dimensions can be ensured sufficiently. Moreover, since the dimension of the interaction space dimension in which electrons can make motions is not completely different from that of the conventional interaction space, the stability of a load depending on phases does not deteriorate.

According to the magnetron described in the above (17), since the distribution of an electric field does not change abruptly, and diffusion of electrons in the axial direction is suppressed by virtue of the shape of the boss of the input-side end hat, the load stability improves.

According to the magnetron described in the above (18), since noises in a frequency band of 30 MHz or less is reduced, the volumes of anti-noise components, such as a coil and a capacitor, can be made small, and cost reduction can be attained by that much.

DESCRIPTION OF THE PREFERRED EMBODIMENTS

Hereinafter, magnetrons according to preferred embodiments of the present invention will be described in detail with the accompanying drawings.

Embodiment 1

Figure 1:
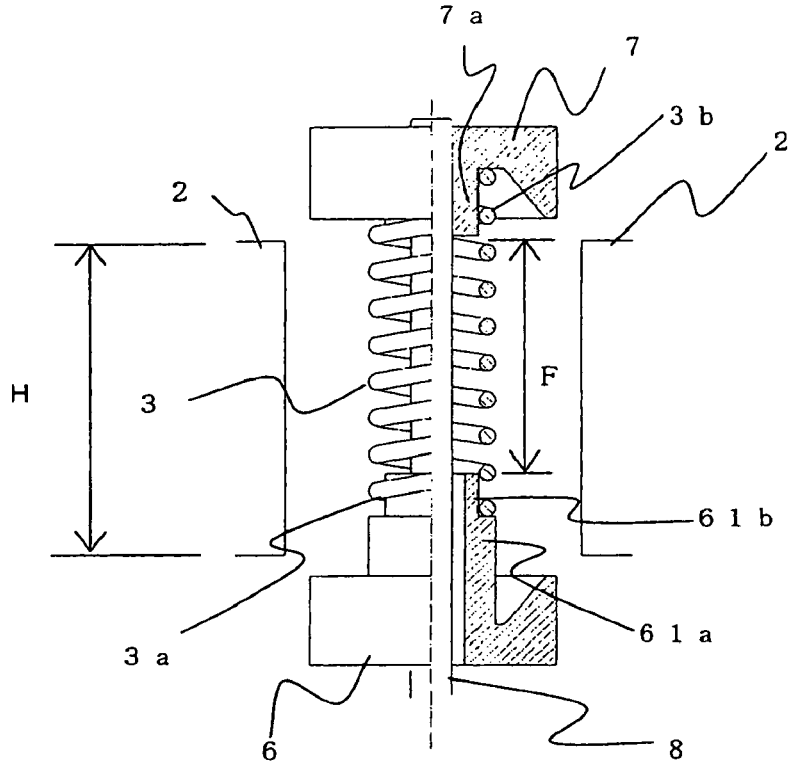
FIG. 1 is a partially sectional view of a magnetron according to Embodiment 1 of the present invention.

FIG. 1 is a partially longitudinal sectional view showing a cathode part of a magnetron according to Embodiment 1 of the present invention. In addition, since components other than the cathode part shown in this drawing are the same as the components of the aforementioned conventional magnetron shown in FIG. 32, the description thereof is omitted.

Referring to FIG. 1, the magnetron of the present embodiment is configured such that a coiled filament 3 is arranged between an input-side end hat 61 and an output-side end hat 7 which are supported by a cathode supporting rod 8. In particular, in the present embodiment, the input-side end hat 61 is configured such that a boss 61*a* having a larger diameter than the shape in FIG. 32 extends to the interior of an interaction space, and a boss 61*b* having a smaller diameter and an end 3*a* of the filament 3 are secured to each other. The output-side end hat 7 has the same shape as the conventional end hat, and a boss 7*a* and an end 3*b* of the filament 3 are secured to each other. Here, the dimension of an axial free length part F which is not secured to the end hat 61 and end hat 7 of the filament 3, that is, which is capable of emitting electrons, is set to about 75% of the plate-like vanes 2 the axial dimension H of which is set to 9.5 mm, and the position of the axial free length part F which forms an electron emission part is arranged so as to be displaced to the output side.

In this way, by shortening the electron emission part in the axial direction, and displacing the electron emission part in the axial direction with respect to the intersection space, emission of electrons at the axial ends of the interaction space where an orthogonal electromagnetic field is not maintained is suppressed on one side. This adjusts the total electron emission amount while minimizing the motion of the electrons mainly at the axial ends of the interaction space which causes noises which propagates through a power line or noises emitted to a space. As a result, noises can be reduced over a broader band compared with a case where cylindrical bodies are provided on both sides of a cathode, respectively, as shown in the related art, without deteriorating the stability of a load depending on phases. Also, the number of components can be reduced compared with the case where cylindrical bodies are provided, and the precision of assembly dimensions can be ensured sufficiently.

Here, the experimental results when a microwave oscillation signal was measured for demonstration by the inventors of the present application are shown.

Figure 2:
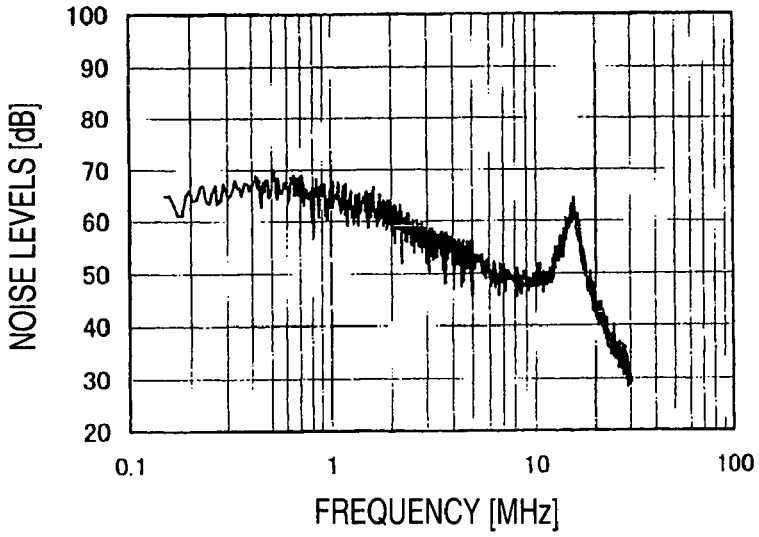
FIG. 2 is a waveform chart showing a noise level of 30 MHz or less in the magnetron of FIG. 1.
Figure 3:
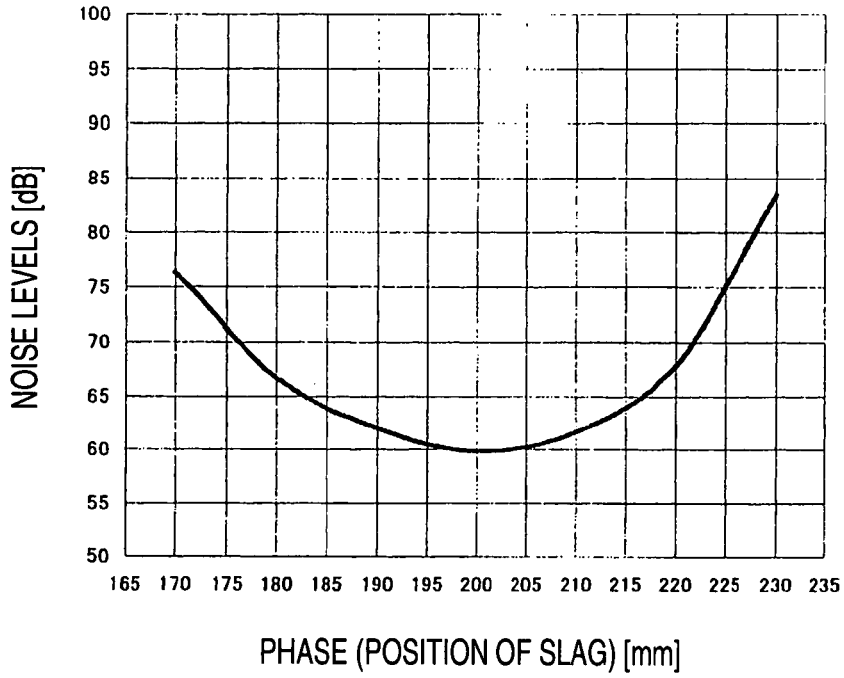
FIG. 3 is a graph showing a change in noise level depending on a phase change in the magnetron of FIG. 1.

FIG. 2 is a waveform chart showing a noise level of 30 MHz or less in a case where the dimension of the axial free length part F which forms the electron emission part of the magnetron that is the present embodiment is set to about 75% of the axial dimension H of the plate-like vanes 2, and the electron emission part is displaced to the output side, and FIG. 3 is a waveform chart showing a noise level in each phase when the voltage standing wave ratio (VSWR) is set to VSWR≅1.5, and phases are changed. In FIG. 3, the abscissa axis represents an insertion point of a slag tuner used for measurement. Since the guide wavelength of a waveguide used for the experiment is about 140 mm, it returns to the same position at about 70 mm that is a half-wavelength. Also, FIG. 4 is a graph showing a change in the noise level of the magnetron when the dimension of the axial free length part F which forms the electron emission part is changed with the electron emission part being not displaced in the axial direction of the plate-like vanes but arranged in the middle of the anode tube, and FIG. 5 is a graph showing the oscillation efficiency of the magnetron and a change in the noise level of the magnetron when the dimension of the axial free length part F which forms the electron emission part is changed with the electron emission part displaced to the output side.

Figure 13:
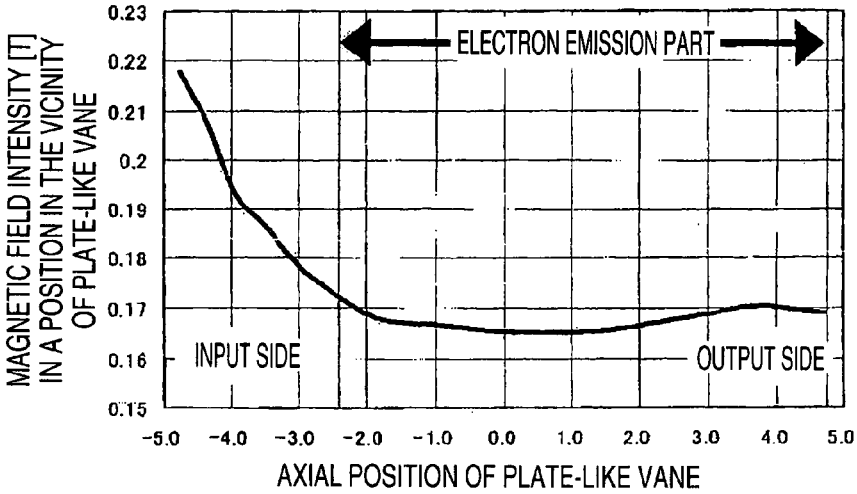
FIG. 13 is a graph showing the magnetic field intensity in the vicinity of plate-like vanes in the magnetron of FIG. 10.

As apparent from FIG. 2, in the case of the present embodiment, a noise level of 30 MHz or less is reduced as compared with the conventional article shown in FIG. 13 which cylindrical bodies are not provided at all.

Figure 36:
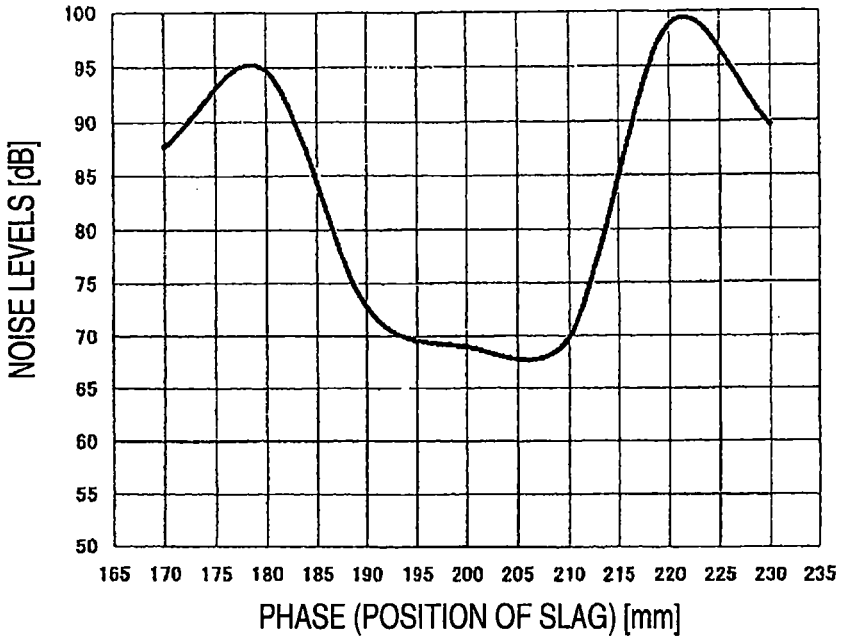
FIG. 36 Prior Art
FIG. 36 is a graph showing a change in noise level depending on a phase change in the magnetron of FIG. 32.
Figure 37:
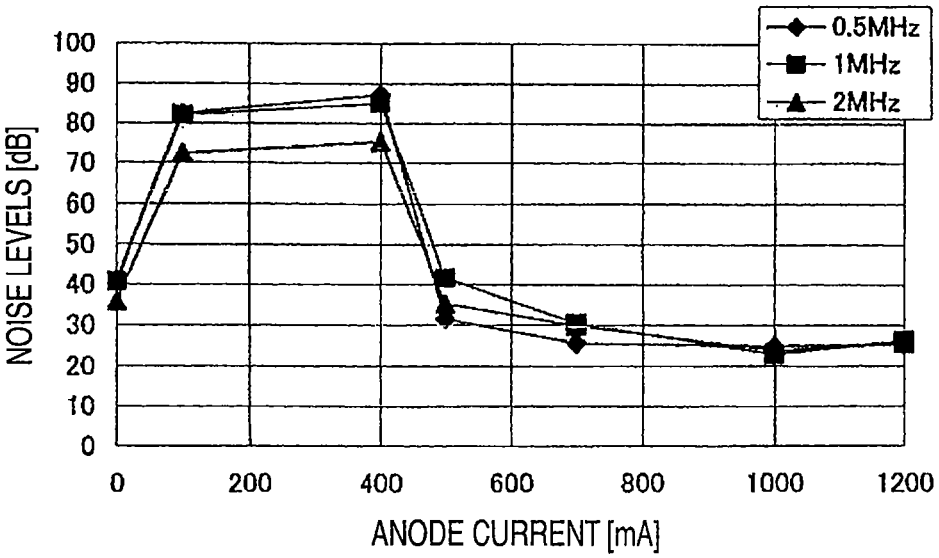
FIG. 37 Prior Art
FIG. 37 is a graph showing the relationship between an anode current and a noise level in the magnetron of FIG. 32.
Figure 38:
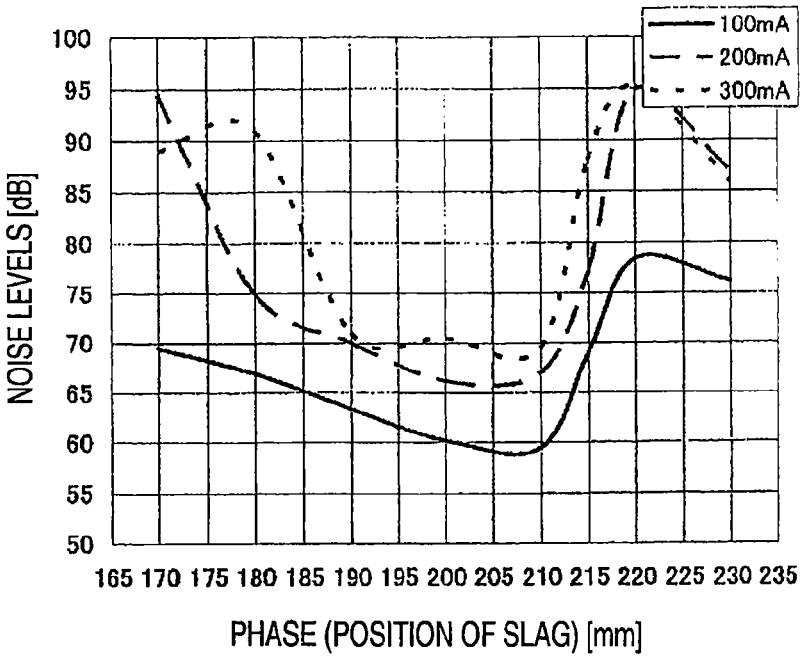
FIG. 38 Prior Art
FIG. 38 is a graph showing a change in noise level depending on a phase change at an average anode current value of 100 mA, 200 mA, and 300 mA when the wire diameter and pitch of a filament in the magnetron of FIG. 32 are set to 0.4 and 1.3, respectively.

As also apparent from FIG. 3, in the case of the present embodiment, a change in noise depending on phases is suppressed low as compared with the conventional article shown in FIG. 36 which cylindrical bodies are not provided at all.

Figure 4:
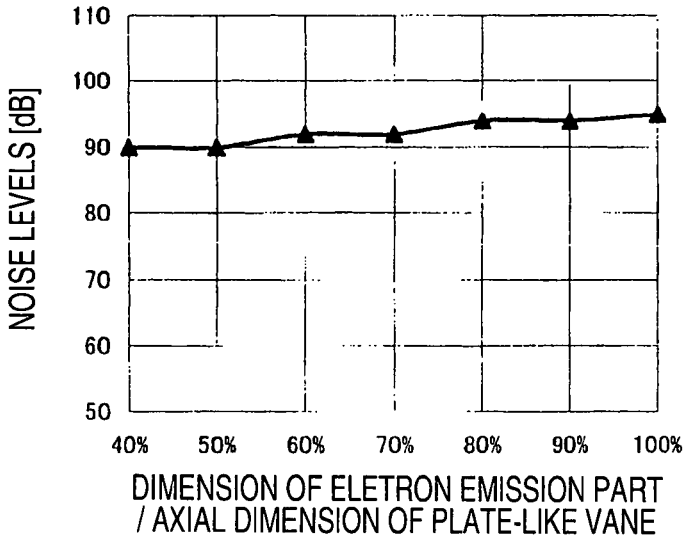
FIG. 4 is a graph showing a change in the noise level of the magnetron when the dimension of an axial free length part F which forms an electron emission part is changed with the electron emission part arranged in the middle of the anode tube.
Figure 5:
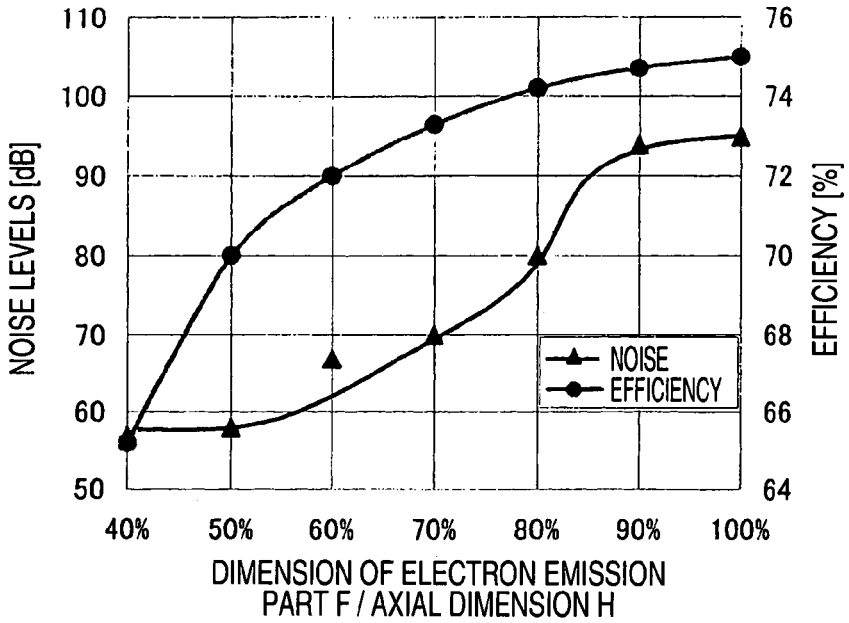
FIG. 5 is a graph showing the oscillation efficiency of the magnetron and a change in the noise level of the magnetron when the dimension of the axial free length part F which forms the electron emission part is changed with the electron emission part displaced to the output side.

As for the position of the electron emission part, as apparent from FIG. 4, the nozzle level hardly changes even if the dimension of the axial free length part F which forms the electron emission part is changed in a state where the electron emission part is disposed in the middle without being displaced in the axial direction of the plate-like vanes. However, as apparent from FIG. 5, in a case where the electron emission part is displaced to the output side, the nozzle level also varies if the dimension of the axial free length part F which forms the electron emission part. Accordingly, in order to reduce the noise level, it is effective to displace the electron emission part in the axial direction of the plate-like vanes.

On the other hand, as apparent from FIG. 5, if the dimension of the axial free length part F which forms the electron emission part is 50% or more of the axial dimension H of the plate-like vanes 2, 70% or more of the oscillation efficiency of the magnetron can be ensured. This is because mainly the motion of electrons in the middle of the interaction space contributes to the oscillation efficiency of the magnetron. Moreover, as apparent from FIG. 5, if the dimension of the axial free length part is 80% or less of the axial dimension H of the plate-like vanes 2, it is possible to suppress the level of noises low.

Embodiment 2

Figure 6:
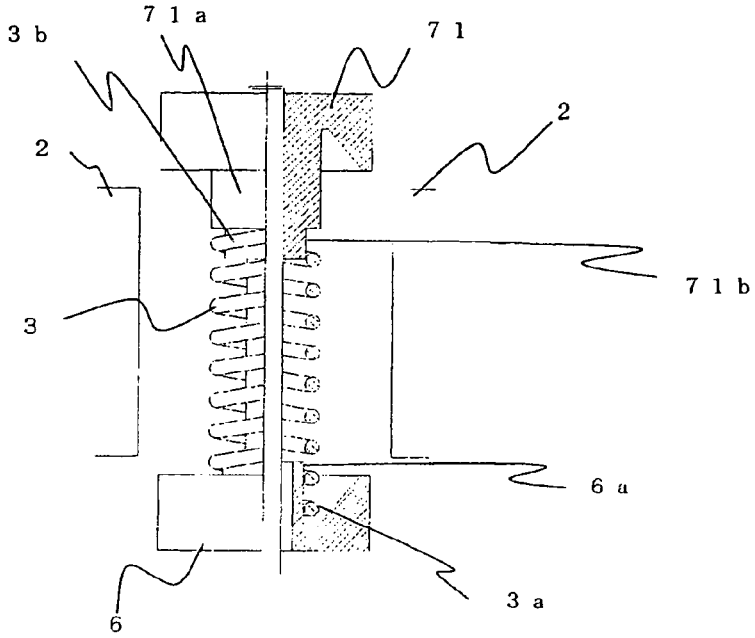
FIG. 6 is a partially sectional view of a magnetron according to Embodiment 2 of the present invention.

FIG. 6 is a partially longitudinal sectional view showing a cathode part of a magnetron according to Embodiment 2 of the present invention. In addition, since components other than the cathode part shown in this drawing are the same as the components of the aforementioned conventional magnetron shown in FIG. 32, the description thereof is omitted.

In FIG. 6, a magnetron of the present embodiment is configured such that the cathode in FIG. 1 showing the above-described Embodiment 1 are turned upside down, and the electron emission part is displaced to the input side.

Figure 7:
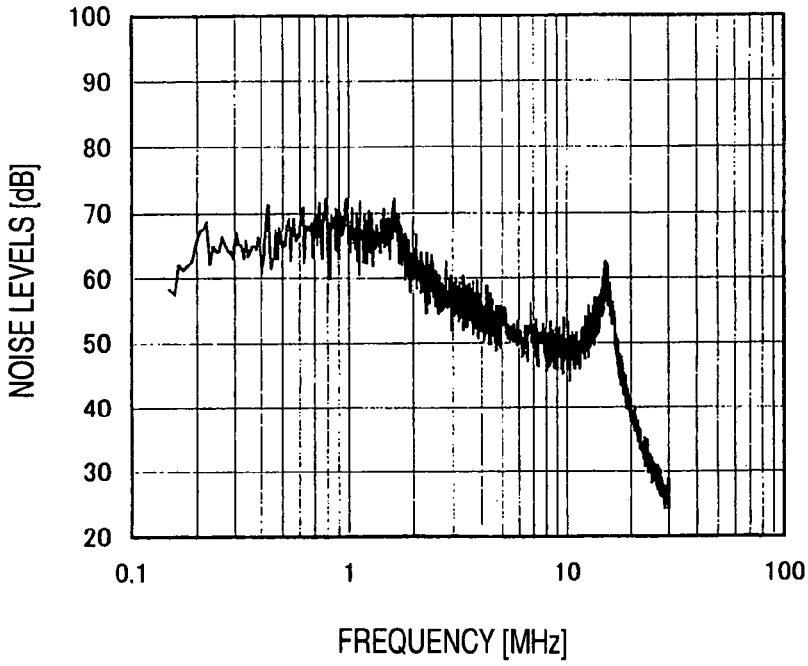
FIG. 7 is a waveform chart showing a noise level of 30 MHz or less in the magnetron of FIG. 6.

FIG. 7 is a waveform chart showing a noise level of 30 MHz or less when the dimension of the electron emission part that is the present embodiment is set to about 75% of the axial dimension of the plate-like vanes, and the electron emission part is displaced to the input side.

Figure 35:
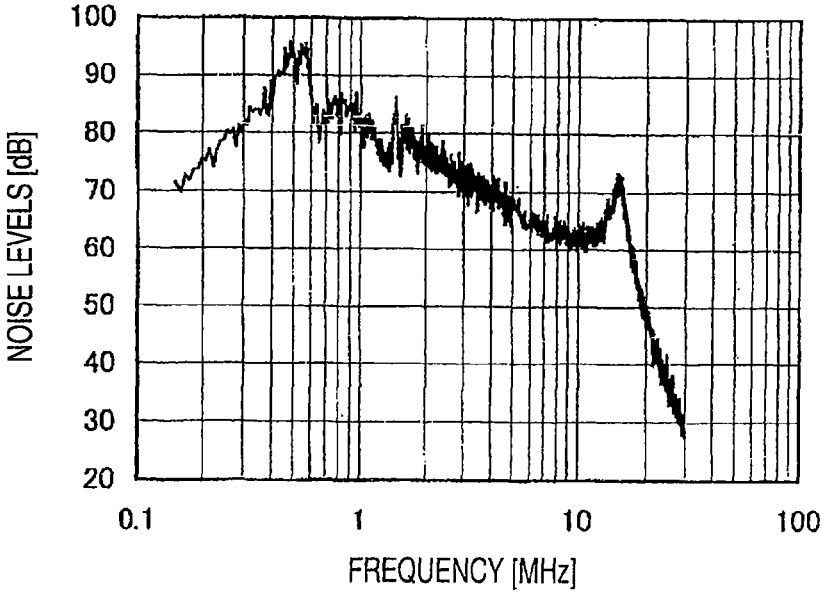
FIG. 35 Prior Art
FIG. 35 is a waveform chart showing a noise level of 30 MHz or less in the magnetron of FIG. 32.

Even if the electron emission part is displaced to the input side like the present embodiment, a noise level of 30 MHz or less is suppressed low as compared with the conventional article shown in FIG. 35 which cylindrical bodies are not provided at all. However, a greater noise-reducing effect is obtained in the case shown in FIG. 2 where the electron emission part is displaced to the output side.

In addition, even in the present embodiment, an increase in the number of components can be suppressed, and the precision of assembly dimensions can be ensured sufficiently.

Embodiment 3

Figure 8:
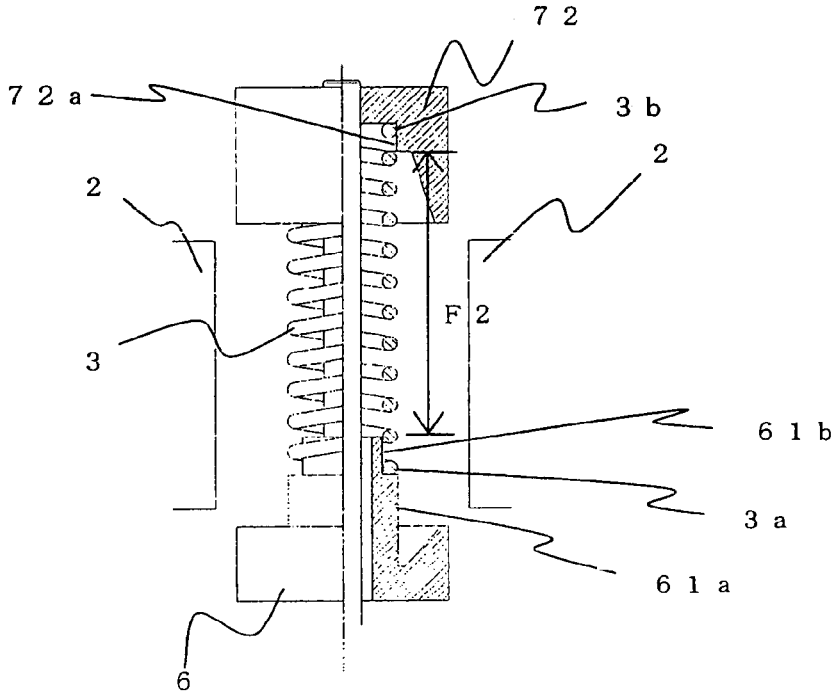
FIG. 8 is a partially sectional view of a magnetron according to Embodiment 3 of the present invention.

FIG. 8 is a partially longitudinal sectional view showing a cathode part of a magnetron according to Embodiment 3 of the present invention. In addition, since components other than the cathode part shown in this drawing are the same as the components of the aforementioned conventional magnetron shown in FIG. 32, the description thereof is omitted.

In FIG. 8, a magnetron of the present embodiment is configured such that an electron emission part is arranged so as to extend into a recess 72*a* of an output-side end hat 72. Describing this embodiment referring to the drawing, the input-side end hat 61 has the same configuration as that shown in FIG. 1 showing Embodiment 1. The output-side end hat shown in FIG. 1 is configured such that the boss 7*a* of the output-side end hat 7 and an internal-diameter part at the end 3*b* of the filament 3 are secured to each other, whereas the output-side end hat 72, as shown in FIG. 8, is configured such that an inner surface 72*a* of a smaller-diameter part of the multi-stepped recess of the output-side end hat 72, and an external-diameter part at the end 3*b* of the filament 3 are secured to each other. Therefore, the filament 3 is arranged so as to extend into the recess 72 of the output-side end hat 72, and the dimension of an axial free length part F2 which forms an electron emission part can be ensured so as to be greater than the axial free length part F of Embodiment 1 shown in FIG. 1, and is made equal to the conventional one shown in FIG. 32. As described above, although the dimension of the electron emission part is equal to the conventional one, the electron emission part is displaced to the output side, and the dimension of the electron emission part which faces the plate-like vanes in the interaction space is set to about 75% of the axial direction of the plate-like vanes.

Figure 9:
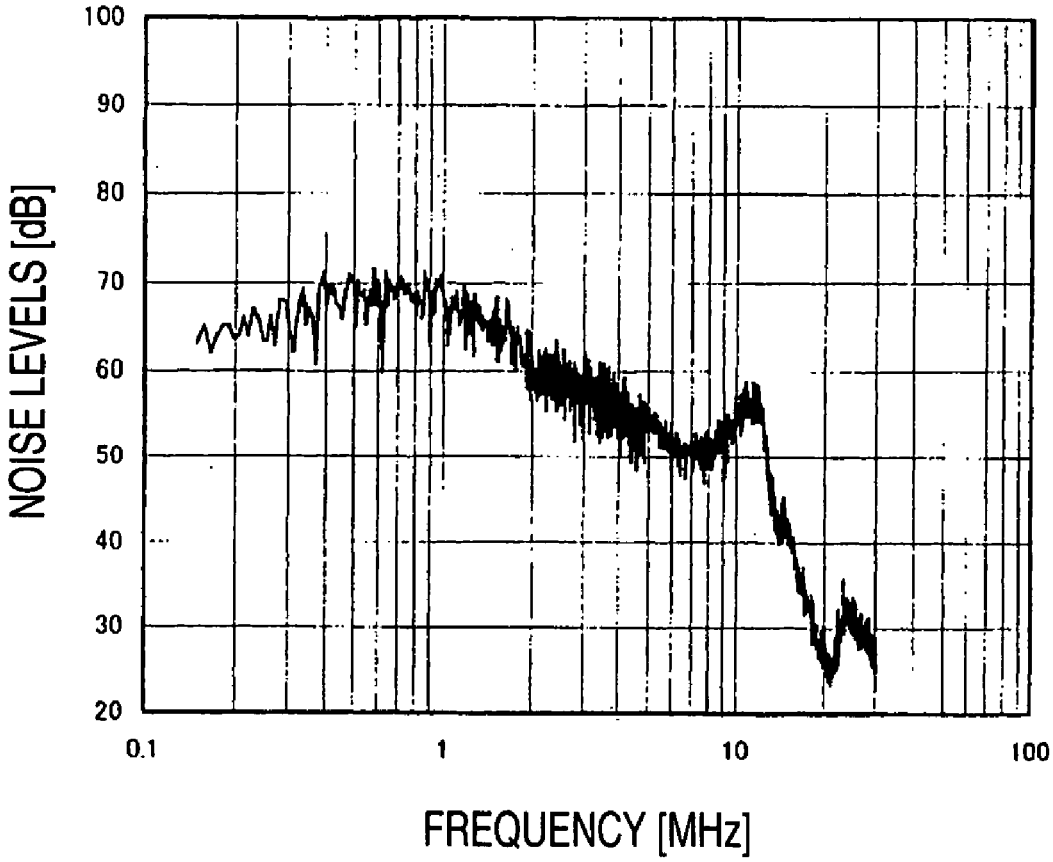
FIG. 9 is a waveform chart showing a noise level of 30 MHz or less in the magnetron of FIG. 8.

FIG. 9 is a waveform chart showing a noise level of 30 MHz or less in a case where the electron emission part that is the present embodiment is arranged so as to extend to the inner surface 72*a* of the smaller-diameter part of the multi-stepped recess of the output-side end hat 72. A noise level of 30 MHz or less in the present embodiment is suppressed low as compared with the conventional article shown in FIG. 35 which cylindrical bodies are not provided at all. As described above, even if the dimension of the electron emission part itself is equal to the conventional one, noises can be reduced by displacing the electron emission part.

As described hitherto, according to the magnetron of the present embodiment, the electron emission part in the interaction space is displaced in the axial direction, so that noises in a low frequency band of 30 MHz or less can also be simultaneously reduced as well as noises in a band of 30 MHz to 200 MHz can be reduced more than the conventional article in which cylindrical bodies are not provided at all or the case where the same ones as the cylindrical bodies 4 and 5 are provided on both sides of the cathode 3.

Also, since noises can be reduced similarly to the above even when the magnetron of the present embodiment is used for high-frequency utilizing apparatuses, such as microwave ovens, the volumes of anti-noise components, such as a coil and a capacitor, can be made small, and cost reduction can be attained by that much.

Embodiment 4

Figure 10:
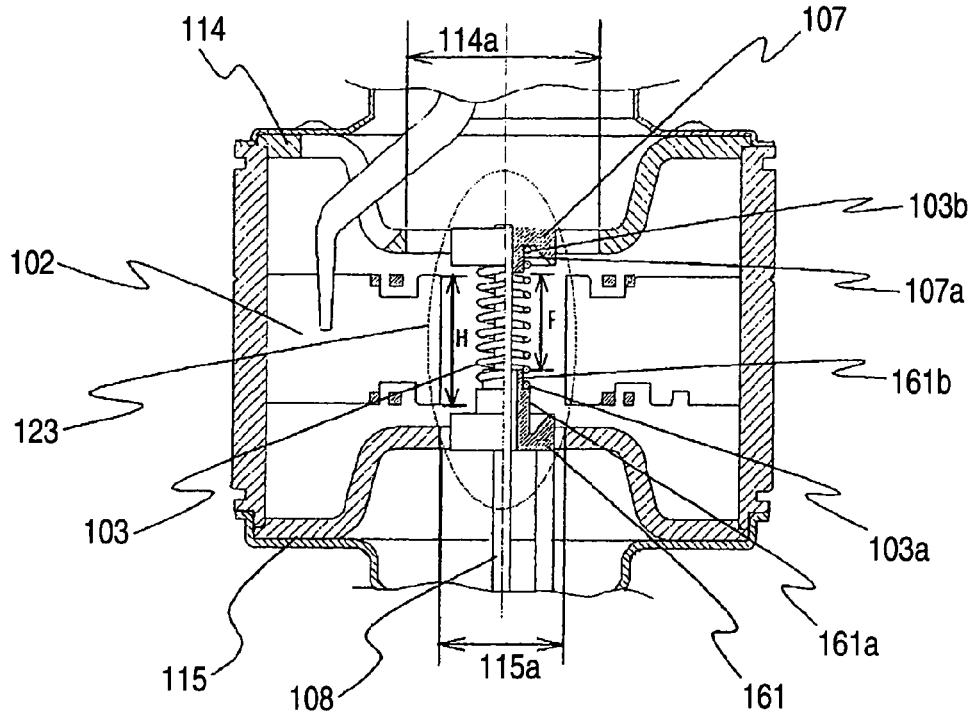
FIG. 10 is a partially sectional view of a magnetron according to Embodiment 4 of the present invention.

FIG. 10 is a partially longitudinal sectional view showing an interaction space in which electrons of a magnetron according to Embodiment 4 of the present invention make motions. In addition, since components other than the cathode part shown in this drawing are the same as the components of the aforementioned conventional magnetron shown in FIG. 32, the description thereof is omitted.

Referring to FIG. 10, the magnetron of the present embodiment is configured such that a coiled filament 103 is arranged between an input-side end hat 161 and an output-side end hat 107 which are supported by a cathode supporting rod 108. In particular, in the present embodiment, the input-side end hat 161 is configured such that a boss 161*a* having a larger diameter than the shape in FIG. 32 extends to the interior of an interaction space, and a boss 161*b* having a smaller diameter and an end 103*a* of the filament 103 are secured to each other. The output-side end hat 107 has the same shape as the conventional end hat, and a boss 107*a* and an end 103*b* of the filament 103 are secured to each other. Here, the dimension of an axial free length part F which is not secured to the end hat 161 and end hat 107 of the filament 103, that is, which is capable of emitting electrons, is set to about 75% of the plate-like vanes 102 the axial dimension H of which is set to 9.5 mm, and the position of the axial free length part F which forms an electron emission part is arranged so as to be displaced to the output side. Moreover, the diameter 115*a* of a through hole formed in the center of a pole piece 115 arranged on the output side is set to $\phi$ 11.5 mm, and the diameter 114*a* of a through hole formed in the center of a pole piece 114 arranged on the input side is set to ϕ 9.0 mm.

In this way, by shortening the electron emission part in the axial direction, and displacing the electron emission part in the axial direction with respect to the intersection space, emission of electrons at the axial ends of the interaction space where an orthogonal electromagnetic field is not maintained is suppressed on one side. This adjusts the total electron emission amount while minimizing the motion of the electrons mainly at the axial ends of the interaction space which causes noises which propagates through a power line or noises emitted to a space. As a result, noises can be reduced over a broader band compared with a case where cylindrical bodies are provided on both sides of a cathode, respectively, as shown in the related art, without deteriorating the stability of a load depending on phases. Moreover, the diameters of the through holes formed in the centers of the pole pieces are made different from each other on the input side and output side whereby the magnetic field intensity in an interaction space where electrons make motions becomes almost uniform. As a result, the number of components can be reduced compared than the case where cylindrical bodies are provided on both sides of a cathode, and the precision of assembly dimensions can be ensured sufficiently.

Here, the experimental results when a microwave oscillation signal was measured for demonstration by the inventors of the present application are shown.

Figure 11:
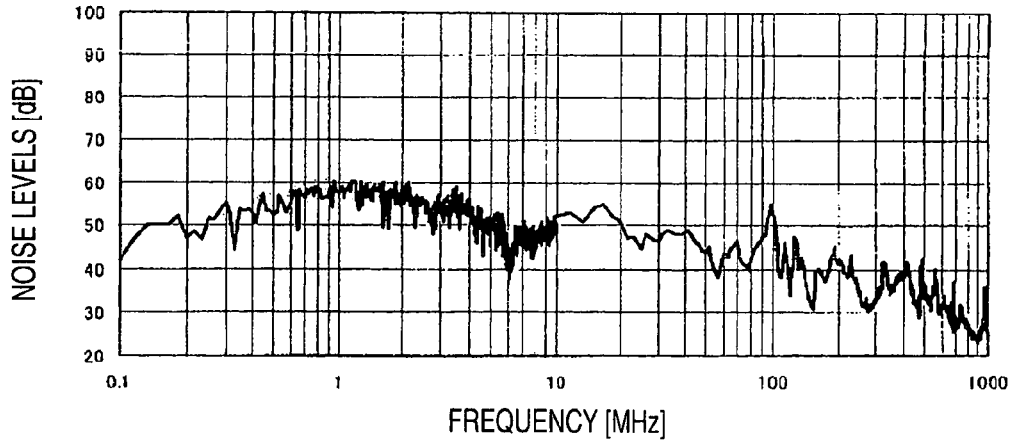
FIG. 11 is a waveform chart showing noise levels of 1 GHz or less in the magnetron of FIG. 10.
Figure 12:
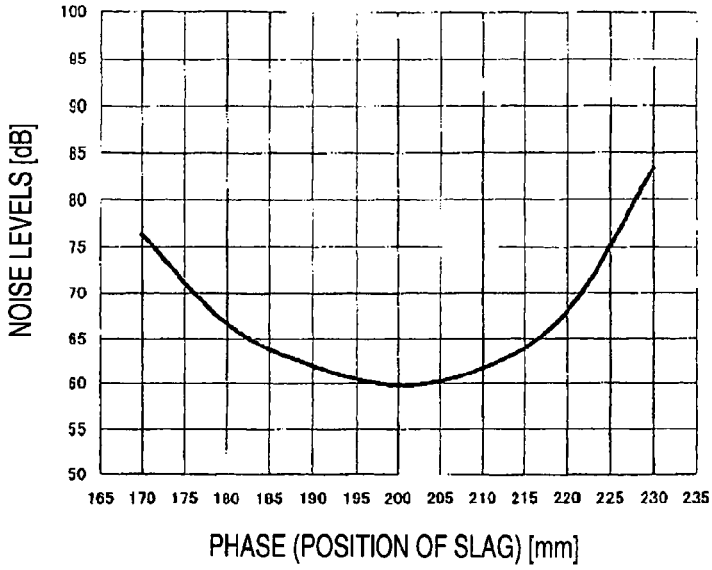
FIG. 12 is a graph showing a change in noise level depending on a phase change in the magnetron of FIG. 10.
Figure 14:
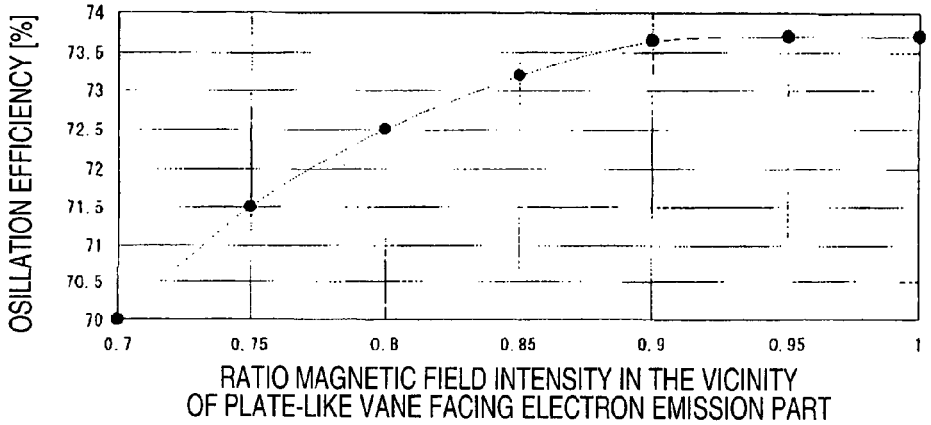
FIG. 14 is a graph showing the relationship between the ratio of a maximum value (Bmax) and a minimum value (Bmin) of the axial magnetic field intensity in the vicinity of the plate-like vanes which face the electron emission part in the magnetron of FIG. 10, and oscillation efficiency.

FIG. 11 is a waveform chart showing a noise level of 1 GHz or less in a case where the dimension of the axial free length part F which forms the electron emission part of the magnetron that is the present embodiment is set to about 75% of the axial dimension H of the plate-like vanes 102, the electron emission part is displaced to the output side, the diameter 114*a* of the central through hole of the input-side pole piece is set to ϕ 11.5 mm, and the diameter 114*a* of the central through hole of the output-side pole piece is set to ϕ 9.0, and FIG. 12 is a waveform chart showing a noise level in each phase when the voltage standing wave ratio (VSWR) is set to VSWR≅1.5, and phases are changed. In FIG. 12, the abscissa axis represents an insertion point of a slag tuner used for measurement. Since the guide wavelength of a waveguide (not shown) used for the experiment is about 140 mm, it returns to the same position at about 70 mm that is a half-wavelength. FIG. 13 is a graph showing the magnetic field intensity in the vicinity of the plate-like vanes at this time. Also, FIG. 14 is a graph showing the relationship between the ratio (Bmin)/(Bmax) of a maximum value (Bmax) and a minimum value (Bmin) of the axial magnetic field intensity in the vicinity of the plate-like vanes which face the electron emission part, and oscillation efficiency.

Figure 34:
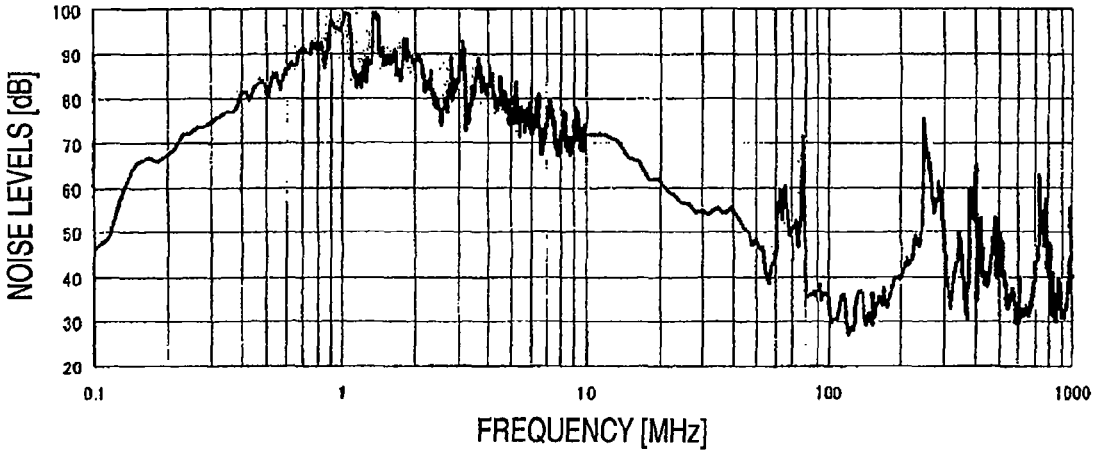
FIG. 34 Prior Art
FIG. 34 is a waveform chart showing noise levels of 1 GHz or less in the magnetron of FIG. 32.

As apparent from FIG. 11, in the case of the present embodiment, a noise level of 1 GHz or less, especially 30 MHz or less is reduced as compared with the conventional article shown in FIG. 34 which cylindrical bodies are not provided at all.

As also apparent from FIG. 12, in the case of the present embodiment, a change in noise depending on phases is suppressed low as compared with the conventional article shown in FIG. 36 which cylindrical bodies are not provided at all at both ends of the cathode.

Figure 39:
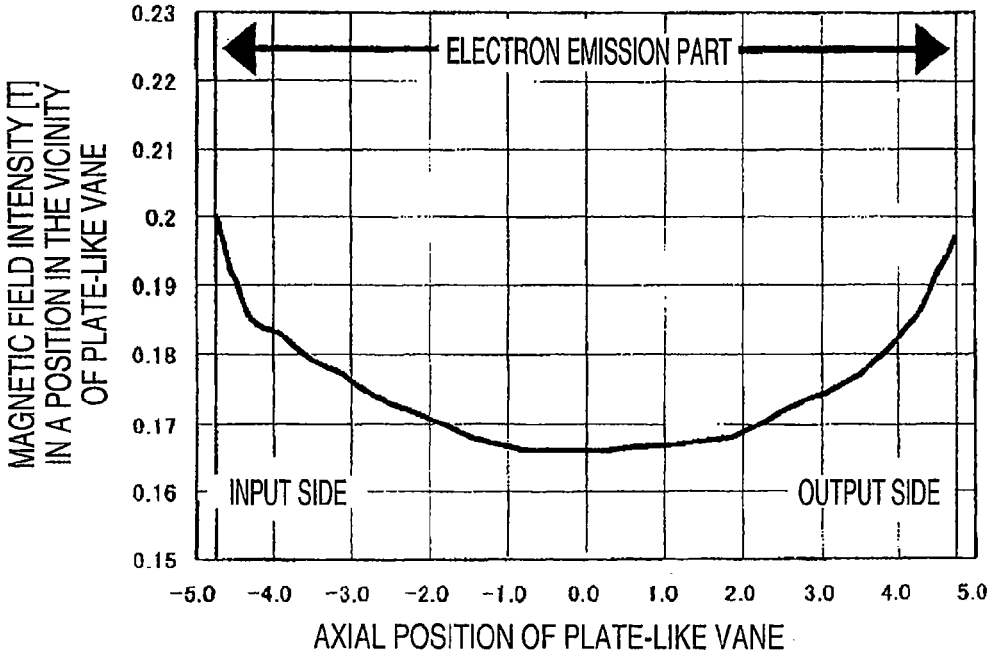
FIG. 39 Prior Art
FIG. 39 is a graph showing the magnetic field intensity in the vicinity of the plate-like vanes in the magnetron of FIG. 32.

It can also be understood FIG. 13 that, as compared with the conventional article shown in FIG. 39 in which cylindrical bodies are not provided at all, an axial position having a minimum value of the axial magnetic field intensity is displaced to the output side. From FIG. 39, the ratio (Bmin)/(Bmax) equals 0.83 at a maximum value (Bmax)=0.200 [T] and a minimum value (Bmin)=0.166 [T] of the axial magnetic field intensity in a position in the vicinity of the plate-like vanes which face the electron emission part of the conventional article in which cylindrical bodies are not provided at all. However, in the present embodiment, as apparent from FIG. 13, the ratio (Bmin)/(Bmax) equals 0.95 at a maximum value (Bmax)=0.173 [T] and a minimum value (Bmin)=0.95 of the axial magnetic field intensity in a position in the vicinity of the plate-like vanes which face the electron emission part, and the drift velocity of electrons determined by electric field intensity and magnetic field intensity becomes almost constant in a space in which electrons make motions. As a result, it is possible to suppress a noise level of 1 GHz or less.

As also apparent from FIG. 14, by setting the ratio (Bmin)/(Bmax) of a maximum value (Bmax) and a minimum value (Bmin) of the axial magnetic field intensity in the vicinity of the plate-like vanes which face the electron emission part to 0.9 to 1.0, a decline in the oscillation efficiency can be suppressed. This is because a motion space which contributes to the oscillation in the axial direction is widened by keeping the magnetic field intensity in the position of the electron emission part almost constant.

Embodiment 5

Figure 15:
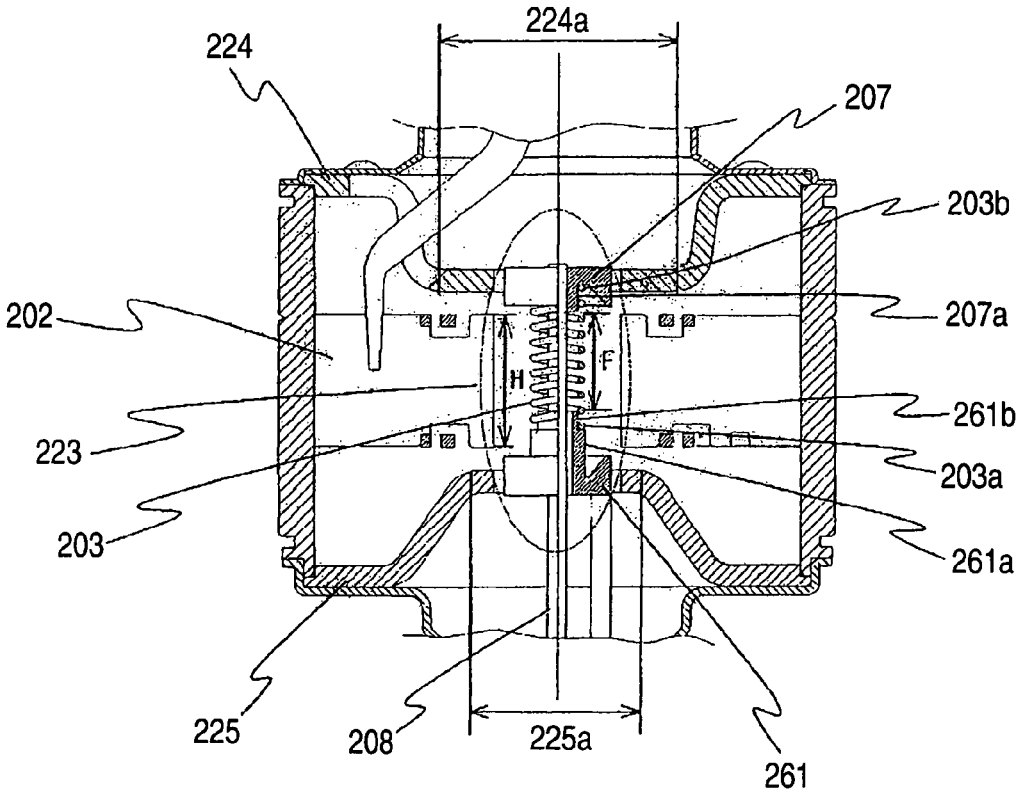
FIG. 15 is a partially sectional view of a magnetron according to Embodiment 5 of the present invention.

FIG. 15 is a partially longitudinal sectional view showing an interaction space in which electrons of a magnetron according to Embodiment 5 of the present invention make motions. In addition, since components other than the cathode part shown in this drawing are the same as the components of the aforementioned conventional magnetron shown in FIG. 32, the description thereof is omitted.

Referring to FIG. 15, the magnetron of the present embodiment is configured such that a coiled filament 103 is arranged between an input-side end hat 161 and an output-side end hat 107 which are supported by a cathode supporting rod 108. In particular, in the present embodiment, the input-side end hat 161 is configured such that a boss 161*a* having a larger diameter than the shape in FIG. 32 extends to the interior of an interaction space, and a boss 161*b* having a smaller diameter and an end 103*a* of the filament 103 are secured to each other. The output-side end hat 107 has the same shape as the conventional end hat, and a boss 107*a* and an end 103*b* of the filament 103 are secured to each other. Here, the dimension of an axial free length part F which is not secured to the end hat 161 and end hat 107 of the filament 103, that is, which is capable of emitting electrons, is set to about 75% of the plate-like vanes 102 the axial dimension H of which is set to 9.5 mm, and the position of the axial free length part F which forms an electron emission part is arranged so as to be displaced to the output side. Moreover, the diameter 124*a* of a smaller-diameter flat part of a pole piece 124 arranged on the output side is set to ϕ 18.0 mm, and the diameter 125*a* of a smaller-diameter flat part of a pole piece 125 arranged on the input side is set to ϕ 14.0 mm.

Figure 16:
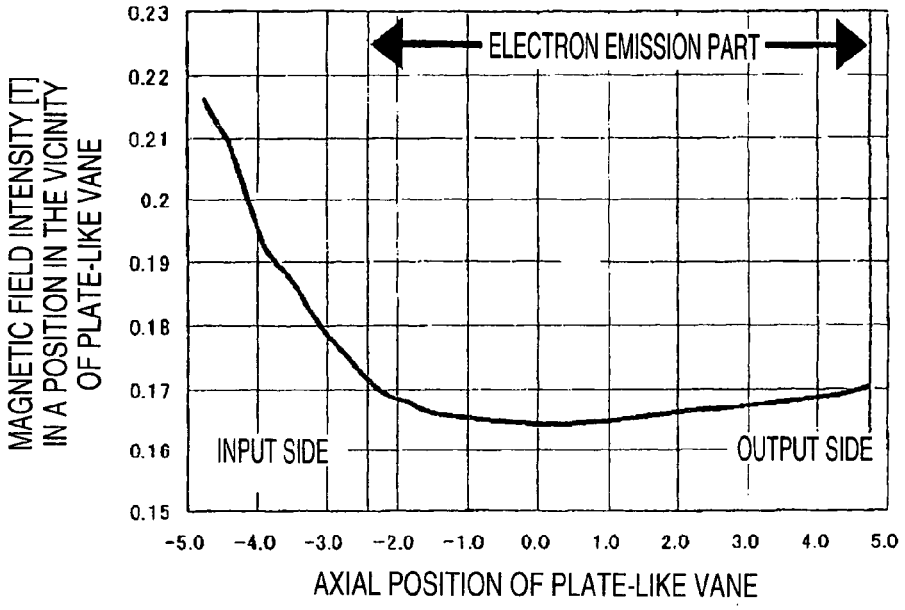
FIG. 16 is a graph showing the magnetic field intensity in the vicinity of the plate-like vanes in the magnetron of FIG. 15.

In this way, by shortening the electron emission part in the axial direction, and displacing the electron emission part in the axial direction with respect to the intersection space, emission of electrons at the axial ends of the interaction space where an orthogonal electromagnetic field is not maintained is suppressed on one side. This adjusts the total electron emission amount while minimizing the motion of the electrons mainly at the axial ends of the interaction space which causes noises. As a result, noises can be reduced over a broader band compared with a case where cylindrical bodies are provided on both sides of a cathode, respectively, as shown in the related art, without deteriorating the stability of a load depending on phases. Moreover, the axial magnetic field intensity in the interaction space in which electrons make motions becomes almost uniform by making the smaller-diameter flat parts formed in the center of the pole pieces different from each other on the input side and output side. Also, as shown in FIG. 16, similarly to Embodiment 4, the ratio of a maximum value (Bmax) and a minimum value (Bmin) of the axial magnetic field intensity in a position in the vicinity of the plate-like vanes which face the electron emission part becomes 0.95. As a result, as compared with the conventional article in which cylindrical bodies are not provided at all, a noise level of 1 GHz or less is reduced while a decline in oscillation efficiency is suppressed, and a change in noise depending on phases is suppressed low.

Embodiment 6

Figure 17:
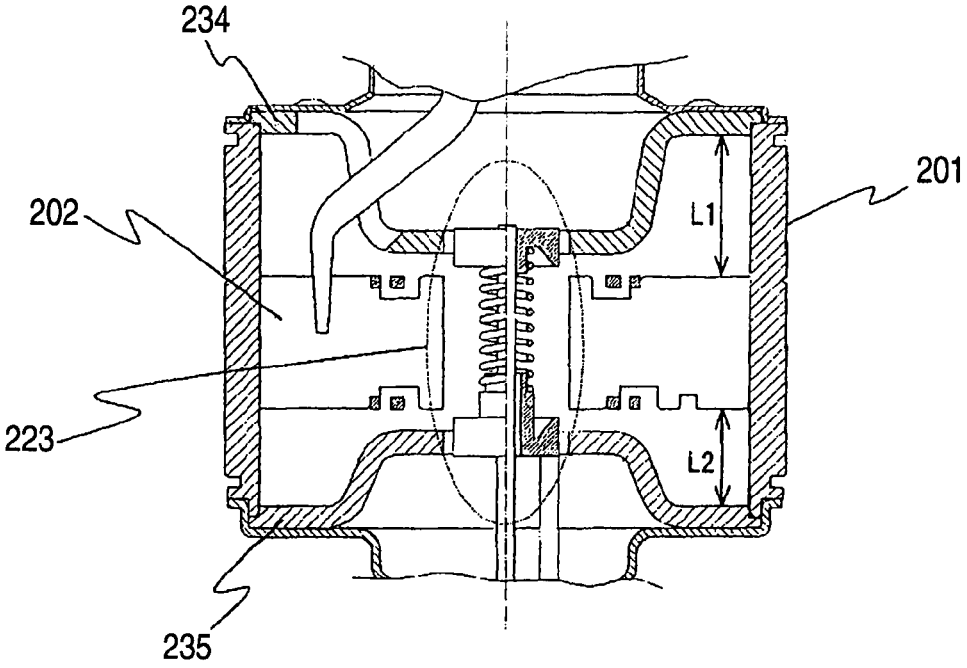
FIG. 17 is a partially sectional view of a magnetron according to Embodiment 6 of the present invention.

FIG. 17 is a partially longitudinal sectional view showing an interaction space in which electrons of a magnetron according to Embodiment 6 of the present invention make motions. In addition, since components other than the cathode part shown in this drawing are the same as the components of the aforementioned conventional magnetron shown in FIG. 32, the description thereof is omitted.

Referring to FIG. 17, although the magnetron of the present embodiment is the same as Embodiment 4 in the positional relationship between the plate-like vanes 102, the cathode 103, and smaller-diameter flat parts of pole pieces 134 and 135, an electron emission part is displaced such that the output-side distance L1 is larger than the input-side distance L2 in the distance between an end of the anode tube 101 and the plate-like vanes 102 in the axial direction of the anode tube 101.

Even if the magnetron is configured in this way, similarly to Embodiments 4 and 5, the axial magnetic field intensity in the interaction space in which electrons make motions becomes almost uniform. As a result, the ratio (Bmin)/(Bmax) of a maximum value (Bmax) and a minimum value (Bmin) of the axial magnetic field intensity in the vicinity of the plate-like vanes which face the electron emission part can be set to 0.9 to 1.0.

Embodiment 7

Figure 18:
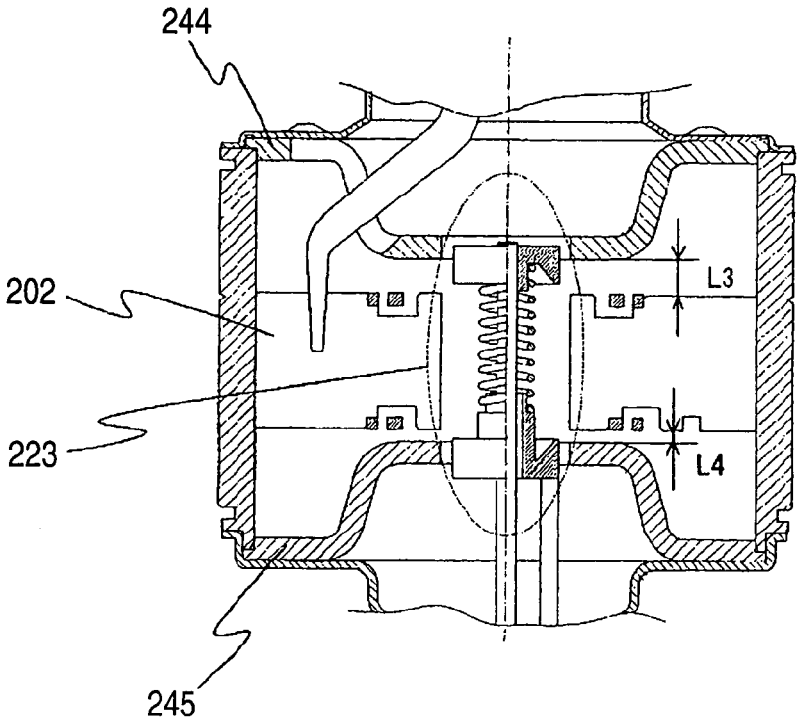
FIG. 18 is a partially sectional view of a magnetron according to Embodiment 7 of the present invention.

FIG. 18 is a partially longitudinal sectional view showing an interaction space in which electrons of the magnetron according to Embodiment 7 of the present invention make motions. In addition, since components other than the cathode part shown in this drawing are the same as the components of the aforementioned conventional magnetron shown in FIG. 32, the description thereof is omitted.

Referring to FIG. 18, although the magnetron of the present embodiment is the same as Embodiment 4 in the positional relationship between the plate-like vanes 102 and a cathode 123, the distance L3 between an output-side pole piece 144 and the plate-like vanes 102 is made larger than the distance L4 between an input-side pole piece 145 and the plate-like vanes 102.

Even if the magnetron is configured in this way, similarly to Embodiments 4, 5, and 6, the axial magnetic field intensity in the interaction space in which electrons make motions becomes almost uniform. As a result, the ratio (Bmin)/(Bmax) of a maximum value (Bmax) and a minimum value (Bmin) of the axial magnetic field intensity in the vicinity of the plate-like vanes which face the electron emission part can be set to 0.9 to 1.0.

Embodiment 8

Figure 19:
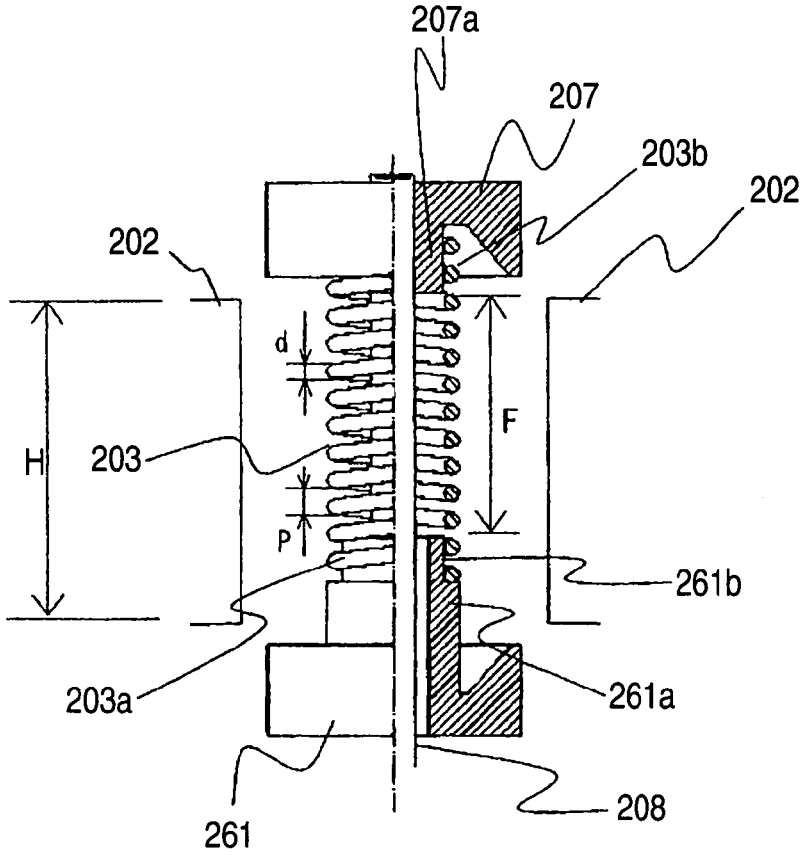
FIG. 19 is a partially sectional view of a magnetron according to Embodiment 8 of the present invention.

FIG. 19 is a partially longitudinal sectional view showing a cathode part of a magnetron according to Embodiment 8 of the present invention. In addition, since components other than the cathode part shown in this drawing are the same as the components of the aforementioned conventional magnetron shown in FIG. 32, the description thereof is omitted.

Referring to FIG. 19, the magnetron of the present embodiment is configured such that a coiled filament 203 is arranged between an input-side end hat 261 and an output-side end hat 207 which are supported by a cathode supporting rod 208. In particular, in the present embodiment, the input-side end hat 261 is configured such that a boss 261*a* having a larger diameter than the shape in FIG. 32 extends to the interior of an interaction space, and a boss 61*b* having a smaller diameter and an end 203*a* of the filament 203 are secured to each other. The output-side end hat 207 has the same shape as the conventional end hat, and a boss 207*a* and an end 203*b* of the filament 203 are secured to each other. Here, the dimension of an axial free length part F which is not secured to the end hat 61 and end hat 207 of the filament 203, that is, which is capable of emitting electrons, is set to about 75% of the plate-like vanes 202 the axial dimension H of which is set to 9.5 mm, and the position of the axial free length part F which forms an electron emission part is arranged so as to be displaced to the output side. Moreover, the wire diameter of the filament 203 is set to ϕ 0.45 mm, and the pitch of the filament is set to ϕ 0.8 mm.

In this way, by shortening the electron emission part in the axial direction, and displacing the electron emission part in the axial direction with respect to the intersection space and appropriately selecting the wire diameter and pitch of the filament, emission of electrons at the axial ends of the interaction space where an orthogonal electromagnetic field is not maintained is suppressed on one side. This adjusts the total electron emission amount while minimizing the motion of the electrons mainly at the axial ends of the interaction space which causes noises which propagates through a power line or noises emitted to a space. As a result, noises can be reduced over a broader band compared with a case where cylindrical bodies are provided on both sides of a cathode, respectively, as shown in the related art, without deteriorating the stability of a load depending on phases. Also, the number of components can be reduced compared with the case where cylindrical bodies are provided, and the precision of assembly dimensions can be ensured sufficiently.

Here, the experimental results when a microwave oscillation signal was measured for demonstration by the inventors of the present application are shown.

Figure 20:
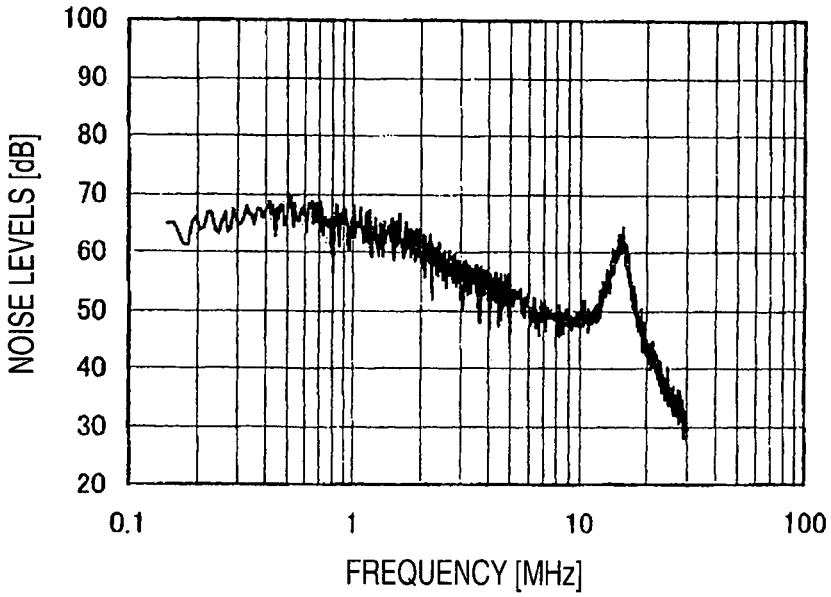
FIG. 20 is a waveform chart showing a noise level of 30 MHz or less in the magnetron of FIG. 19.
Figure 21:
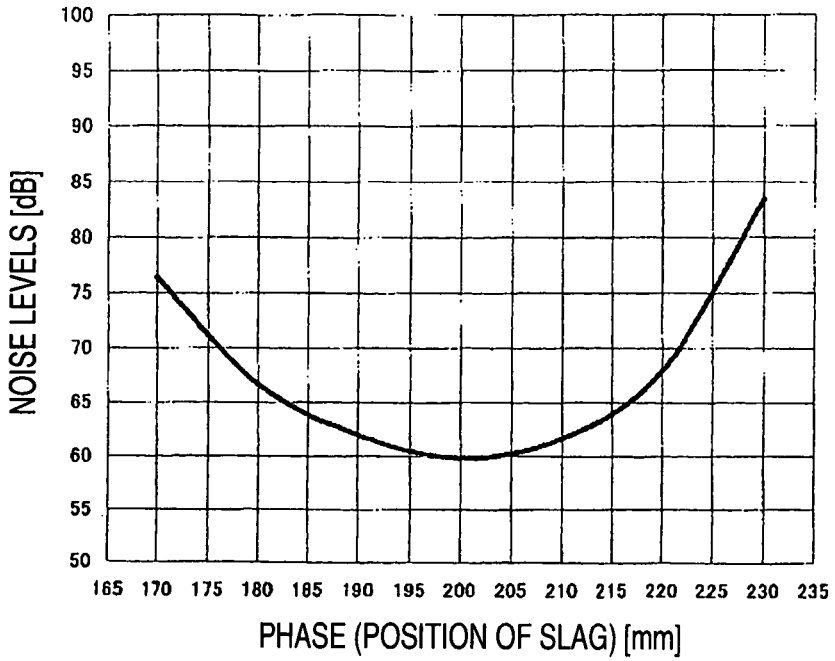
FIG. 21 is a graph showing a change in noise level depending on a phase change in the magnetron of FIG. 19.
Figure 22:
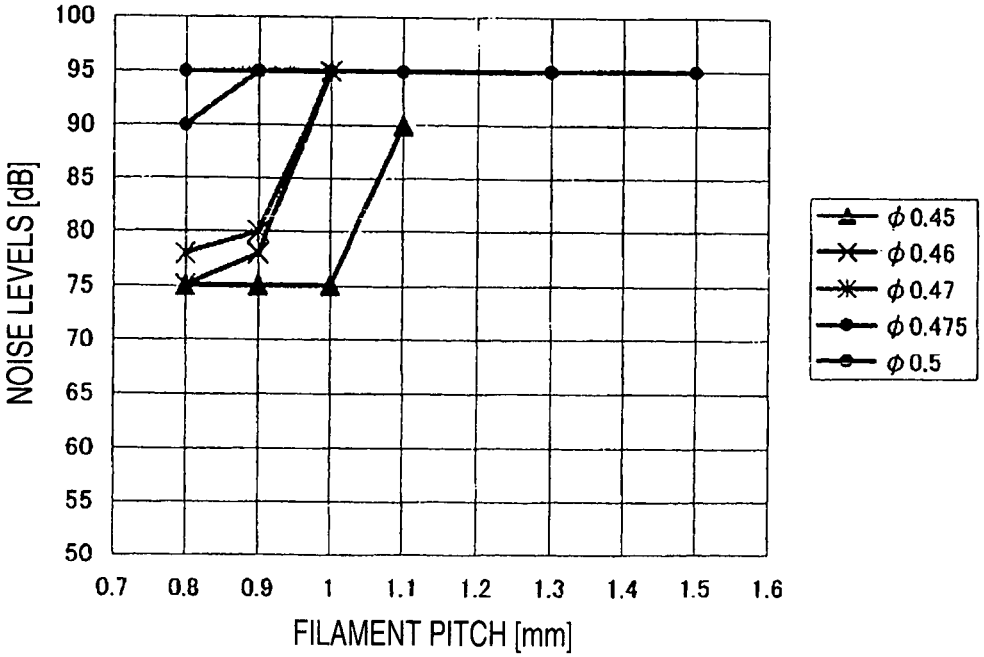
FIG. 22 is a graph showing a change in the noise level of the magnetron of the configuration of FIG. 19 when the wire diameter and pitch of a filament are changed.
Figure 23:
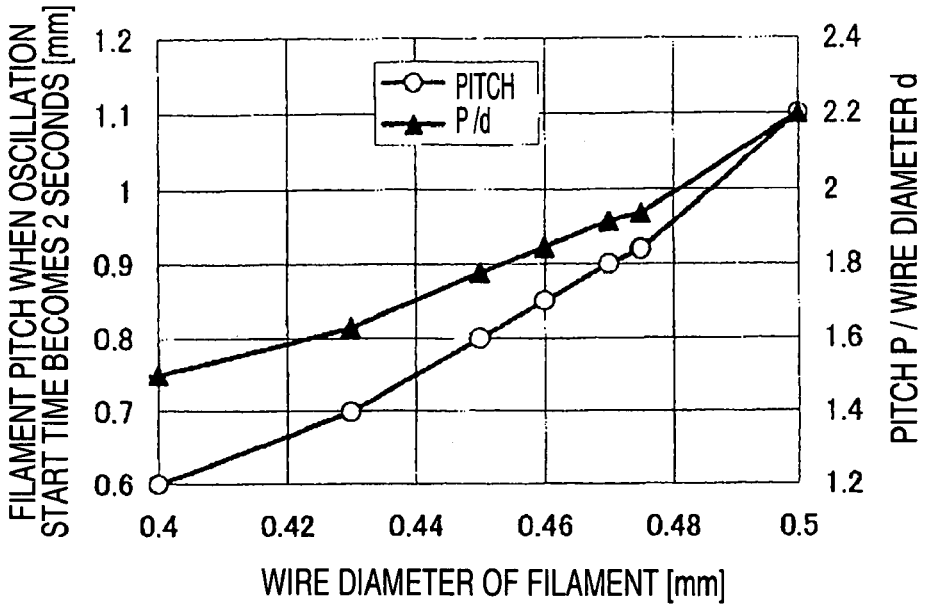
FIG. 23 is a graph showing the pitch of a filament when oscillation start time becomes 2 seconds and the ratio P/d of the pitch P and wire diameter d of the filament, when the wire diameter of the filament in the magnetron of the configuration of FIG. 19 is changed.
Figure 24:
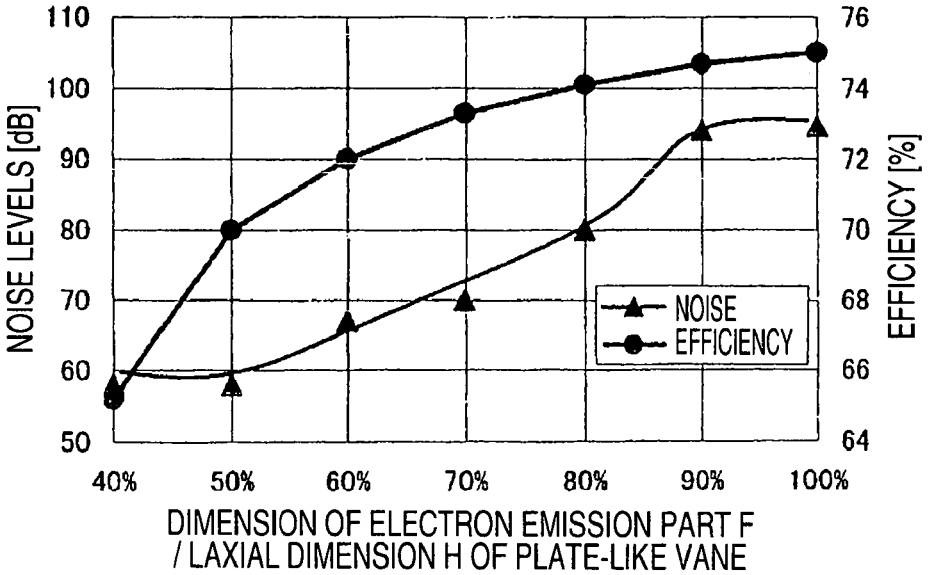
FIG. 24 is a graph showing the oscillation efficiency of the magnetron and a change in the noise level of the magnetron when the dimension of an axial free length part F which forms an electron emission part is changed with the electron emission part displaced to the output side.

FIG. 20 is a waveform chart showing a noise level of 30 MHz or less in a case where the dimension of the axial free length part F which forms the electron emission part of the magnetron that is the present embodiment is set to about 75% of the axial dimension H of the plate-like vanes 202, the electron emission part is displaced to the output side, and the wire diameter of the filament is set to ϕ 0.45 mm and the pitch of the filament is set to ϕ 0.8 mm and FIG. 21 is a waveform chart showing a noise level in each phase when the voltage standing wave ratio (VSWR) is set to VSWR≅1.5, and phases are changed. In FIG. 21, the abscissa axis represents an insertion point of a slag tuner used for measurement. Since the guide wavelength λg of a waveguide used for the experiment is about 140 mm, it returns to the same position at about 70 mm that is a half-wavelength λg/2. Also, FIG. 22 is a graph showing a change in the noise level of the magnetron of the configuration of FIG. 1 when the wire diameter and pitch of a filament are changed. FIG. 23 is a graph showing the pitch of a filament when oscillation start time becomes 2 seconds and the ratio P/d of the pitch P and wire diameter d of the filament, when the wire diameter of the filament in the magnetron of the configuration of FIG. 19 is changed. In a general magnetron, the oscillation start time when an anode voltage and a filament voltage are applied simultaneously is set to be about 2 to 3 seconds. FIG. 24 is a graph showing the oscillation efficiency of the magnetron and a change in the noise level of the magnetron when the dimension of an axial free length part F which forms an electron emission part is changed with the electron emission part displaced to the output side.

Figure 32:
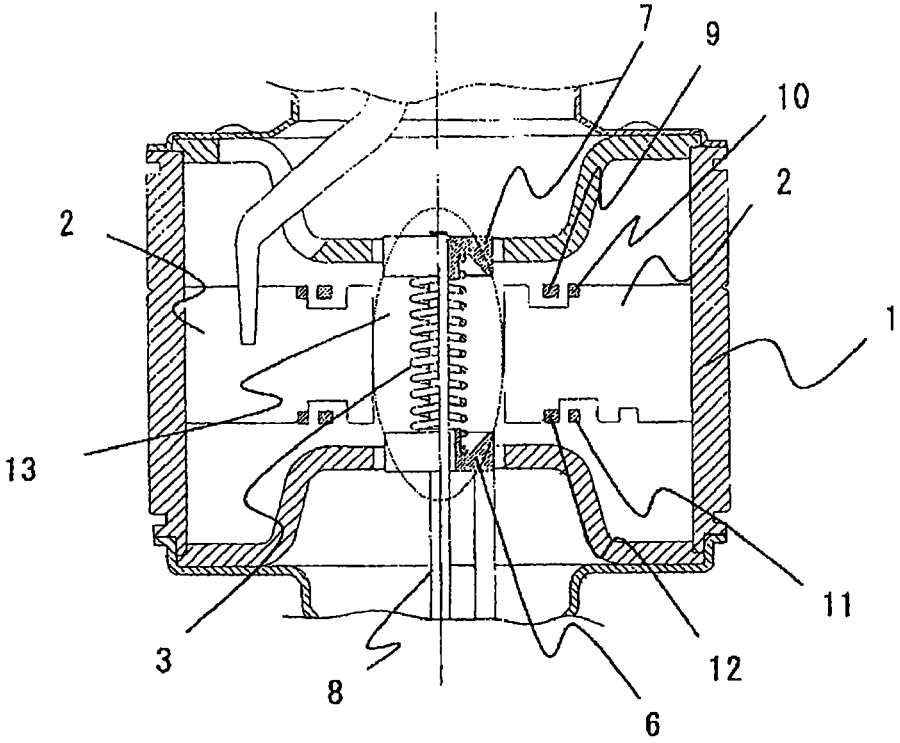
FIG. 32 Prior Art
FIG. 32 is a longitudinal sectional view showing a portion inside an anode tube of a conventional article in which cylindrical bodies are not provided at all.
Figure 33:
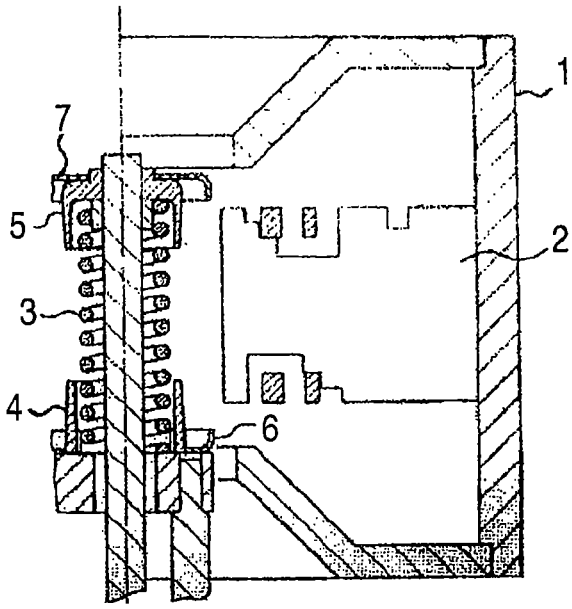
FIG. 33 Prior Art
FIG. 33 is a longitudinal sectional view showing a portion inside an anode tube of a conventional magnetron in which cylindrical bodies are provided at input-side and output-side ends of a cathode.

As apparent from FIG. 20, in the case of the present embodiment, a noise level of 30 MHz or less is reduced as compared with FIG. 35 showing a noise level of 30 MHz of the conventional article shown in FIG. 32 which cylindrical bodies are not provided at all.

As also apparent from FIG. 21, in the case of the present embodiment, a change in noise depending on phases is suppressed low as compared with the conventional article shown in FIG. 36 which cylindrical bodies are not provided at all.

With respect to the wire diameter and pitch of the filament, as apparent from FIG. 22, it turns out that, when the wire diameter is ϕ 0.47 mm or less, the noise level is low and the pitch has an optimum value in each wire diameter, but the noise level is kept low at a wire diameter of about 0.9 mm or less. As apparent from FIG. 23, it also turns out that, as the wire diameter becomes small, the pitch when the oscillation start time becomes 2 seconds becomes narrow. If the ratio P/d of the wire diameter d and pitch P of the filament becomes 1.6 or less, the productivity is reduced, and if the wire diameter becomes small, the mechanical strength is lowered. It is thus believed that the minimum value of the wire diameter is acceptably set to ϕ 0.43 mm.

On the other hand, as apparent from FIG. 24, if the dimension of the axial free length part F which forms the electron emission part is 50% or more of the axial dimension H of the plate-like vanes 202, 70% or more of the oscillation efficiency of the magnetron can be ensured. This is because mainly the motion of electrons in the middle of the interaction space contributes to the oscillation efficiency of the magnetron. Moreover, as apparent from FIG. 24, if the dimension of the axial free length part is 80% or less of the axial dimension H of the plate-like vanes 202, it is possible to suppress the level of noises low.

As described hitherto, according to the magnetron of the present embodiment, the electron emission part in the interaction space is displaced in the axial direction and the wire diameter and pitch of the filament are selected appropriately, so that noises in a low frequency band of 30 MHz or less can also be simultaneously reduced as well as noises in a band of 30 MHz to 200 MHz can be reduced more than the conventional article in which cylindrical bodies are not provided at all or the case where the same ones as the cylindrical bodies 204 and 205 are provided on both sides of the cathode 213.

Also, since noises can be reduced similarly to the above even when the magnetron of the present embodiment is used for high-frequency utilizing apparatuses, such as microwave ovens, the volumes of anti-noise components, such as a coil and a capacitor, can be made small, and cost reduction can be attained by that much.

Embodiment 9

Figure 25:
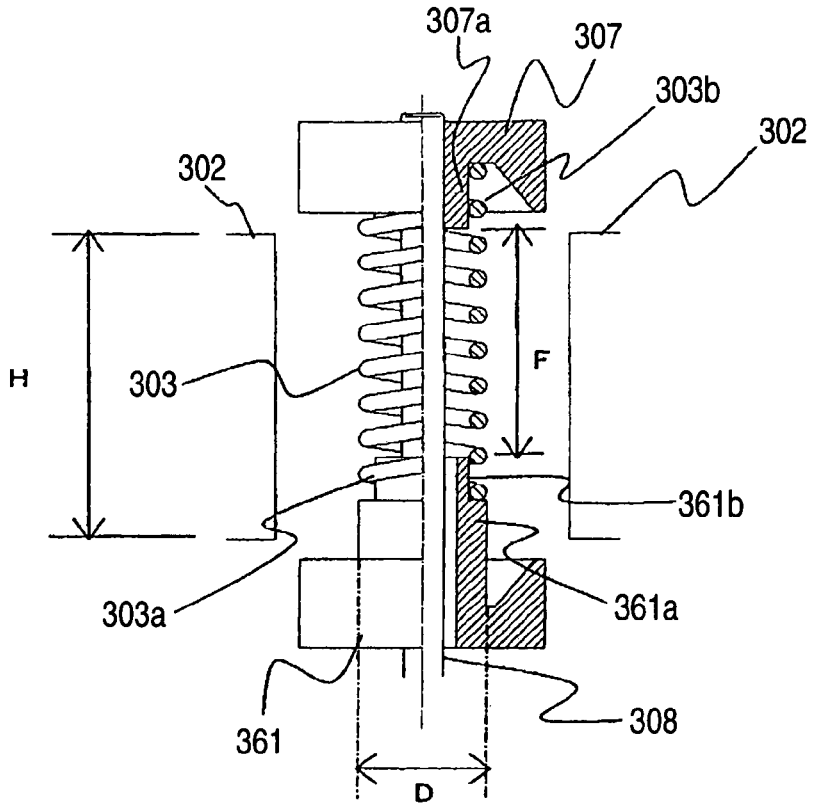
FIG. 25 is a partially sectional view of a magnetron according to Embodiment 9 of the present invention.

FIG. 25 is a partially longitudinal sectional view of a cathode part of a magnetron according to Embodiment 9 of the present invention. In addition, since components other than the cathode part shown in this drawing are the same as the components of the aforementioned conventional magnetron shown in FIG. 32, the description thereof is omitted.

Referring to FIG. 25, the magnetron of the present embodiment is configured such that a coiled filament 303 is arranged between an input-side end hat 361 and an output-side end hat 307 which are supported by a cathode supporting rod 308. In particular, in the present embodiment, the input-side end hat 361 is configured such that a larger-diameter boss 361*a* having a larger diameter than the shape in FIG. 32 extends to the interior of an interaction space, and a smaller-diameter boss 361*b* having a smaller diameter and an end 303*a* of the filament 303 are secured to each other. The output-side end hat 307 has the same shape as the conventional end hat, and a boss 307*a* and an end 303*b* of the filament 303 are secured to each other. Here, the dimension of an axial free length part F which is not secured to the end hat 361 and end hat 307 of the filament 303, that is, which is capable of emitting electrons, is set to about 75% of the plate-like vanes 302 the axial dimension H of which is set to 9.5 mm, and the position of the axial free length part F which forms an electron emission part is arranged so as to be displaced to the output side.

In this way, by shortening the electron emission part in the axial direction, and displacing the electron emission part in the axial direction with respect to the intersection space, emission of electrons at the axial ends of the interaction space where an orthogonal electromagnetic field is not maintained is suppressed on one side. This adjusts the total electron emission amount while minimizing the motion of the electrons mainly at the axial ends of the interaction space which causes noises which propagates through a power line or noises emitted to a space. As a result, noises can be reduced over a broader band compared with a case where cylindrical bodies are provided on both sides of a cathode, respectively, as shown in the related art, without deteriorating the stability of a load depending on phases. Also, the number of components can be reduced compared with the case where cylindrical bodies are provided, and the precision of assembly dimensions can be ensured sufficiently.

Here, the experimental results when a microwave oscillation signal was measured for demonstration by the inventors of the present application are shown.

Figure 26:
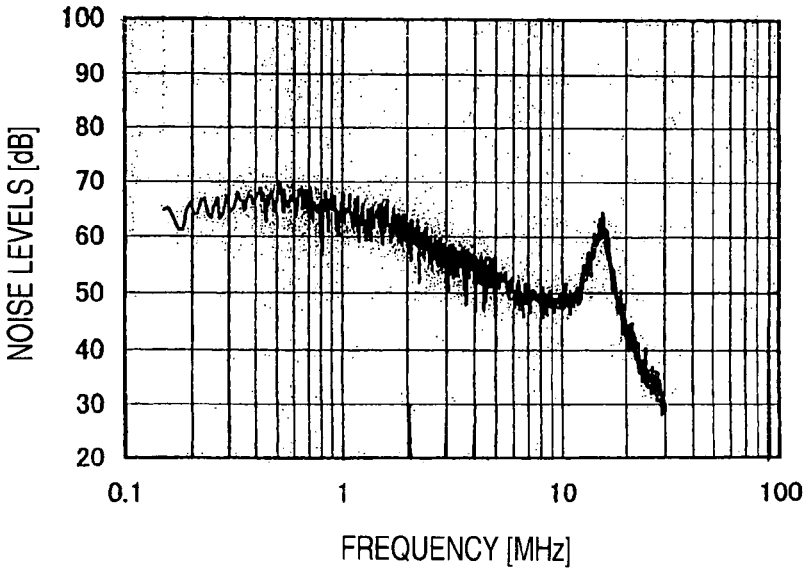
FIG. 26 is a waveform chart showing a noise level of 30 MHz or less in the magnetron of FIG. 25.
Figure 27:
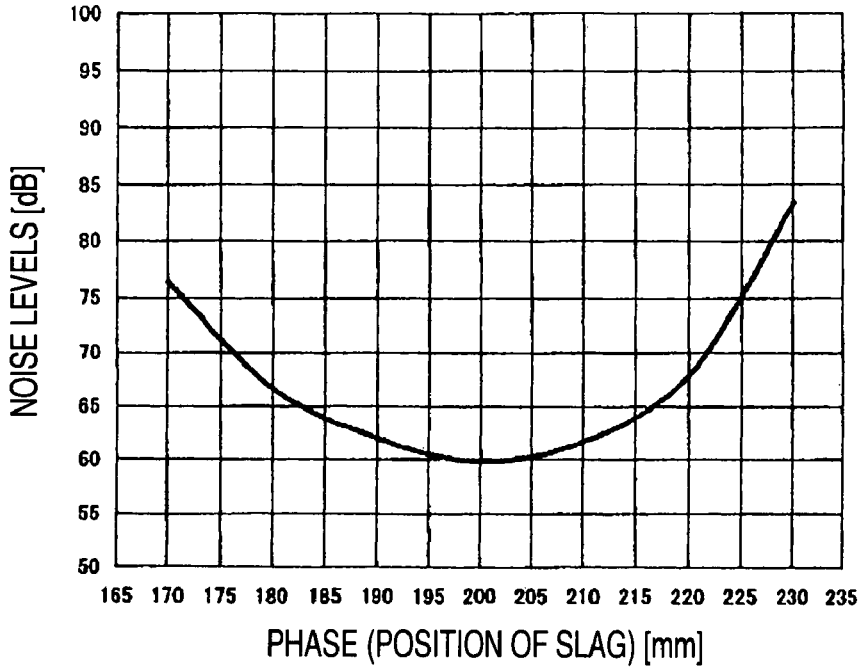
FIG. 27 is a graph showing a change in noise level depending on a phase change in the magnetron of FIG. 25.

FIG. 26 is a waveform chart showing a noise level of 30 MHz or less in a case where the dimension of the axial free length part F which forms the electron emission part of the magnetron that is the present embodiment is set to about 75% of the axial dimension H of the plate-like vanes 302, and the electron emission part is displaced to the output side, and FIG. 27 is a waveform chart showing a noise level in each phase when the voltage standing wave ratio (VSWR) is set to VSWR≅1.5, and phases are changed. In FIG. 27, the abscissa axis represents an insertion point of a slag tuner used for measurement. Since the guide wavelength of a waveguide used for the experiment is about 140 mm, it returns to the same position at about 70 mm that is a half-wavelength. Also, FIG. 28 is a graph showing a change in the noise level of the magnetron when the dimension of the axial free length part F which forms the electron emission part is changed with the electron emission part being not displaced in the axial direction of the plate-like vanes but arranged in the middle of the anode tube, and FIG. 29 is a graph showing the oscillation efficiency of the magnetron and a change in the noise level of the magnetron when the dimension of the axial free length part F which forms the electron emission part is changed with the electron emission part displaced to the output side.

As apparent from FIG. 26, in the case of the present embodiment, a noise level of 30 MHz or less is reduced as compared with noise level characteristics of the conventional article shown in FIG. 35 which cylindrical bodies are not provided at all.

As also apparent from FIG. 27, in the case of the present embodiment, a change in noise depending on phases is suppressed low as compared with noise level characteristics of the conventional article shown in FIG. 36 which cylindrical bodies are not provided at all.

Figure 28:
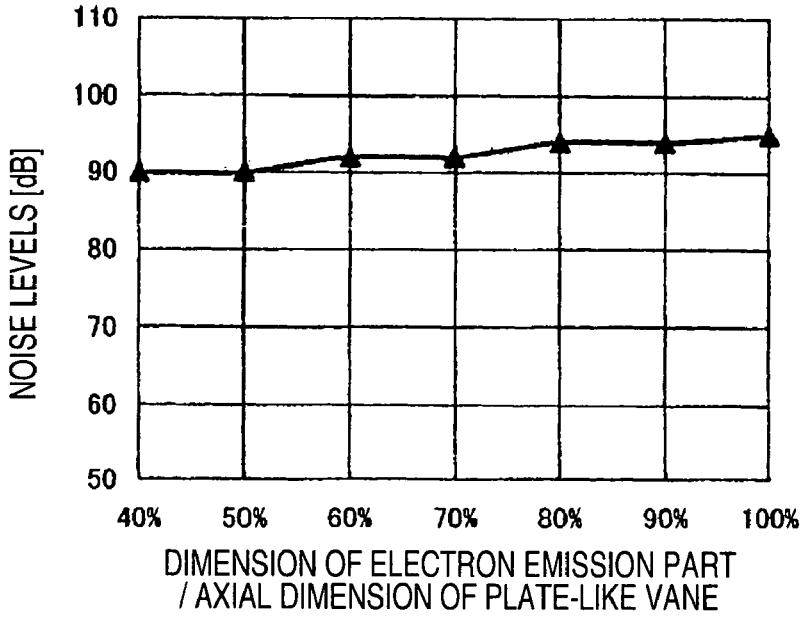
FIG. 28 is a graph showing a change in the noise level of the magnetron when the dimension of an axial free length part F which forms an electron emission part is changed with the electron emission part arranged in the middle of the anode tube.
Figure 29:
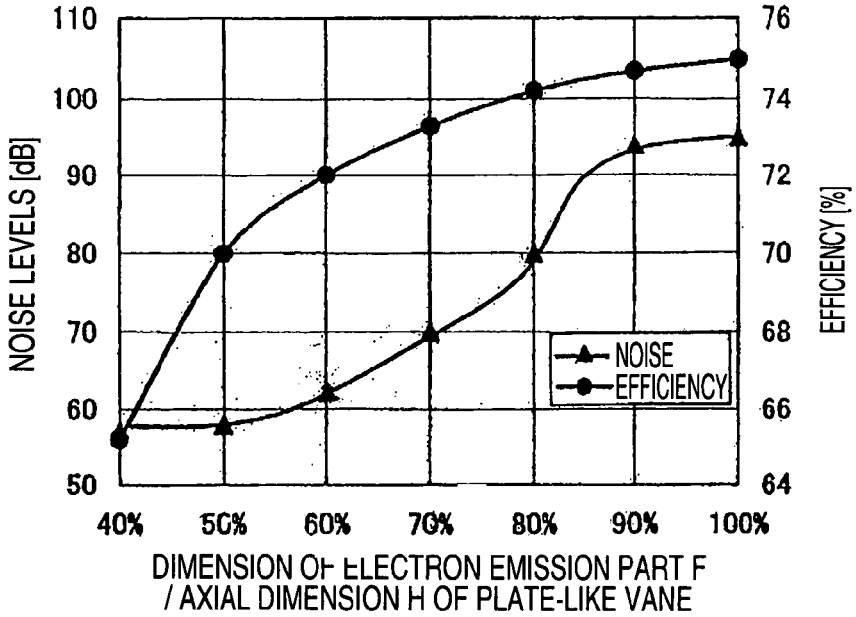
FIG. 29 is a graph showing the oscillation efficiency of the magnetron and a change in the noise level of the magnetron when the dimension of an axial free length part F which forms an electron emission part is changed with the electron emission part displaced to the output side.

As for the position of the electron emission part, as apparent from FIG. 28, the nozzle level hardly changes even if the dimension of the axial free length part F which forms the electron emission part is changed in a state where the electron emission part is disposed in the middle without being displaced in the axial direction of the plate-like vanes. However, as apparent from FIG. 29, in a case where the electron emission part is displaced to the output side, the nozzle level also varies if the dimension of the axial free length part F which forms the electron emission part.

Accordingly, in order to reduce the noise level, it is effective to displace the electron emission part in the axial direction of the plate-like vanes.

On the other hand, as apparent from FIG. 29, if the dimension of the axial free length part F which forms the electron emission part is 50% or more of the axial dimension H of the plate-like vanes 302, 70% or more of the oscillation efficiency of the magnetron can be ensured. This is because mainly the motion of electrons in the middle of the interaction space contributes to the oscillation efficiency of the magnetron. Moreover, as apparent from FIG. 29, if the dimension of the axial free length part is 80% or less of the axial dimension H of the plate-like vanes 302, it is possible to suppress the level of noises a to a low value below 80 dB.

Embodiment 10

Figure 30:
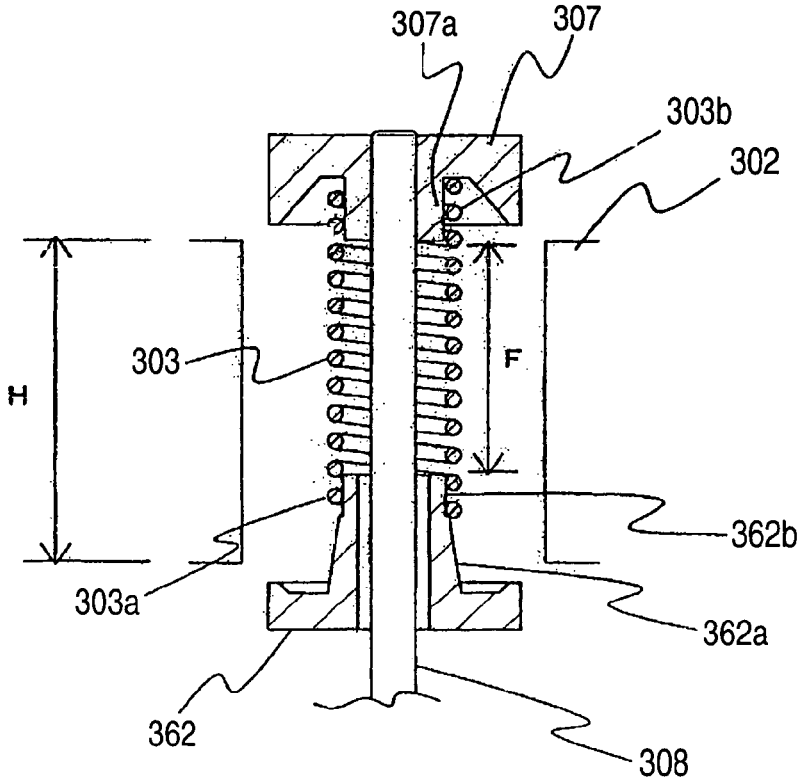
FIG. 30 is a partially sectional view of a magnetron according to Embodiment 9 of the present invention.

FIG. 30 is a partially longitudinal sectional view showing a cathode part of a magnetron according to Embodiment 10 of the present invention. In addition, since components other than the cathode part shown in this drawing are the same as the components of the aforementioned conventional magnetron shown in FIG. 30, the description thereof is omitted.

In FIG. 30, a magnetron of the present embodiment is obtained by changing the shape of the larger-diameter boss of the input-side end hat in FIG. 25 showing the above Embodiment 25.

Figure 31:
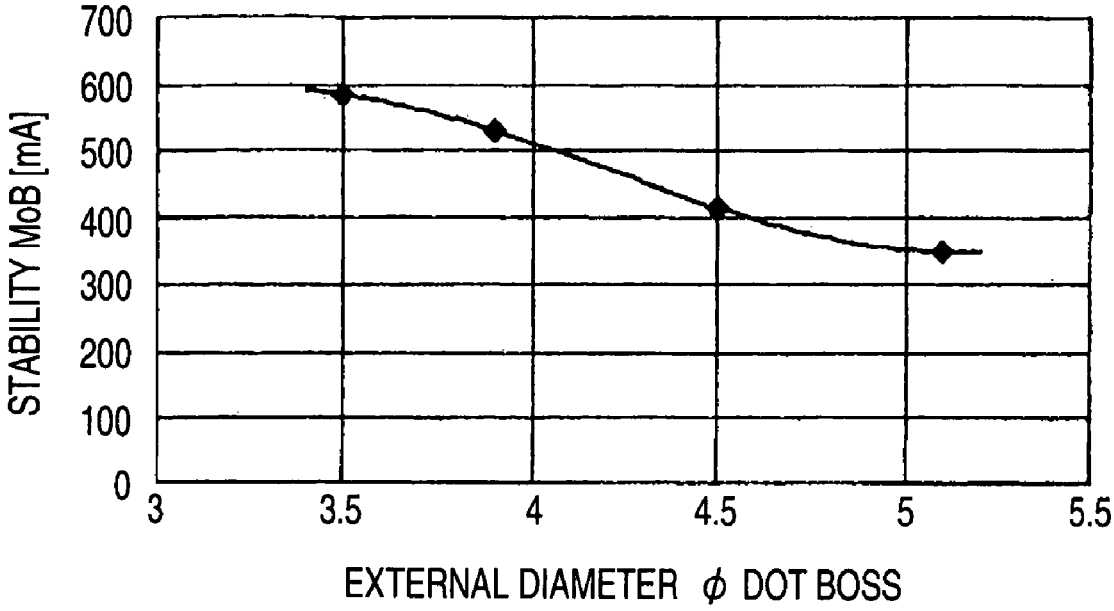
FIG. 31 is a graph showing the relationship of the load stability of the magnetron to the outside dimension of the larger-diameter boss of the input-side end hat in the magnetron of FIG. 25.

FIG. 31 is a graph showing the relationship of the load stability (MoB [mA]) of the magnetron to the external diameter D of the larger-diameter boss 61*a* of the input-side end hat in the magnetron of FIG. 25.

As apparent from FIG. 31, as the external diameter of the larger-diameter boss 361*a* of the input-side end hat is smaller, the load stability of the magnetron improves.

Thus, in the present embodiment, as shown in FIG. 30, the input-side end hat 362 is configured such that a tapered boss 362*a* extends with a reduced diameter towards an interaction space, and a smaller-diameter boss 362*b* is formed with a step at the tip of the tapered boss 362*a*, and the smaller-diameter boss 362*b* of the input-side end hat 362 and one end 303*a* of the filament 303 constituting the cathode are secured to each other.

The other end 303*b* of the filament 303 is secured to a boss 307*a* of the output-side end hat 307, and an axial free length part F which forms an electron emission part of the filament 303 is arranged so as to be displaced to the output side with respect to an axial part H of each plate-like vane 302.

By arranging the electron emission part so as to be displaced in the axial direction in this way, emission of electrons from one of the ends which becomes mainly noise components due to non-uniformity of a magnetic field or electric field is suppressed. Thus, unnecessary emission of electrons is suppressed, and line noises decreases accordingly.

Also, since the distribution of an electric field does not change abruptly, and diffusion of electrons in the axial direction can be suppressed by making the shape of the larger-diameter boss of the input-side end hat into a tapered shape that extends so as to decrease in diameter towards the interaction space, the load stability improves.

Moreover, since pullout strength improves even in press molding of the input-side end hat, magnetrons can be produced in large quantities.

As described hitherto, according to the magnetron of the present embodiment, the electron emission part in the interaction space is displaced in the axial direction, so that noises in a low frequency band of 30 MHz or less can also be simultaneously reduced as well as noises in a band of 30 MHz to 30 MHz can be reduced more than the conventional article in which cylindrical bodies are not provided at all or the case where the same ones as the cylindrical bodies 304 and 305 are provided on both sides of the cathode 303.

Also, since noises can be reduced similarly to the above even when the magnetron of the present embodiment is used for high-frequency utilizing apparatuses, such as microwave ovens, the volumes of anti-noise components, such as a coil and a capacitor, can be made small, and cost reduction can be attained by that much.

The magnetron according to the present invention can be applied to applications using magnetrons, such as microwave ovens, microwave generators, and high-frequency utilizing apparatuses using those apparatuses.

What is claimed is:

1. A magnetron comprising:

a cylindrical anode tube in which a plurality of plate-like vanes are radially disposed toward a central axis;

a cathode disposed on the central axis of the anode tube by a cathode supporting rod, the cathode including a filament; and a pair of end hats provided in positions on the cathode supporting rod to sandwich the cathode in an axial direction; wherein:

the filament is secured by the end hats and includes an axial free length part which is not touched by the end hats, a center of the axial free length part along the axial direction is displaced from a center of the plurality of plate-like vanes along the axial direction, a dimension of the axial free length part is smaller than an axial dimension of the plate-like vanes, a dimension of the entire axial free length part which faces the plate-like vanes is 50% or more and 80% or less of the axial dimension of the plate-like vanes, and an input-side end hat of the pair of end hats is configured such that a boss with a reduced outer diameter extends towards an interaction space, a smaller-diameter boss having a smaller diameter than the boss is formed with a step at the tip of the boss, the smaller-diameter boss of the input-side end hat and one end of a filament constituting the cathode are secured to each other, and the other end of the filament is secured to a boss of an output-side end hat.

2. The magnetron according to claim 1, wherein the center of the axial free length part is arranged so as to be displaced to the output side with respect to the center of the plurality of plate-like vanes.

3. A high-frequency utilizing apparatus comprising the magnetron according to any one of claims 1 and 2.

4. A magnetron comprising:

a cylindrical anode tube in which a plurality of plate-like vanes are radially disposed toward a central axis;

a cathode disposed on the central axis of the anode tube by a cathode supporting rod, the cathode including a filament; and a pair of end hats provided in positions on the cathode supporting rod to sandwich the cathode in an axial direction, wherein:

the filament is secured by the end hats and includes an axial free length part which is not touched by the end hats, a center of the axial free length part along the axial direction is displaced from a center of the plurality of plate-like vanes along the axial direction, a dimension of the axial free length part is smaller than an axial dimension of the plate-like vanes, the axial magnetic field intensity in a position in the vicinity of the plate-like vanes which face the axial free length part is made almost uniform, a dimension of the entire axial free length part which faces the plate-like vanes is 50% or more and 80% or less of the axial dimension of the plate-like vanes, and an input-side end hat of the pair of end hats is configured such that a boss with a reduced outer diameter extends towards an interaction space, a smaller-diameter boss having a smaller diameter than the boss is formed with a step at the tip of the boss, the smaller-diameter boss of the input-side end hat and one end of a filament constituting the cathode are secured to each other, and the other end of the filament is secured to a boss of an output-side end hat.

5. The magnetron according to claim 4, wherein, when a maximum value and a minimum value of the axial magnetic field intensity in the vicinity of the plate-like vanes which face the axial free length part are defined as (Bmax) and (Bmin), respectively, the ratio (Bmin)/(Bmax) is 0.9 to 1.0.

6. The magnetron according to claim 4, wherein the shapes of a pair of pole pieces disposed on both opening ends of the anode tube are made different from each other in order to form the axial magnetic field intensity.

7. The magnetron according to claim 6, wherein, of through holes formed in the centers of smaller-diameter flat parts of the pair of pole pieces disposed on both the opening ends of the anode tube, a through hole on the side of the axial free length part of the cathode that is displaced in the axial direction is made larger.

8. The magnetron according to claim 6, wherein the diameter of a smaller-diameter flat part of a pole piece of the pair of pole pieces on the side of the axial free length part of the cathode that is displaced in the axial direction is made larger.

9. The magnetron according to claim 6, wherein the axial height of a pole piece of the pair of pole pieces on the side of the axial free length part of the cathode that is displaced in the axial direction is made larger.

10. The magnetron according to claim 4, wherein the distance between the plate-like vanes and a pole piece of the pair of pole pieces is made larger on the side of the axial free length part of the cathode that is displaced in the axial direction.

11. A high-frequency utilizing apparatus comprising the magnetron according to any one of claims 4 to 10.

12. A magnetron comprising:

a cylindrical anode tube in which a plurality of plate-like vanes are radially disposed toward a central axis, a cathode disposed on the central axis of the anode tube by a cathode supporting rod, the cathode including a filament; and a pair of end hats provided in positions on the cathode supporting rod to sandwich the cathode in an axial direction, wherein:

the filament is secured by the end hats and includes an axial free length part which is not touched by the end hats, a center of the axial free length part along the axial direction is displaced from a center of the plurality of plate-like vanes along the axial direction, a dimension of the axial free length part is smaller than an axial dimension of the plate-like vanes, a wire diameter of the filament is ψ 0.43mm to ψ 0.47, and the pitch of which is 0.9 mm or less, and an input-side end hat of the pair of end hats is configured such that a boss with a reduced outer diameter extends towards an interaction space, a smaller-diameter boss having a smaller diameter than the boss is formed with a step at the tip of the boss, the smaller-diameter boss of the input-side end hat and one end of a filament constituting the cathode are secured to each other, and the other end of the filament is secured to a boss of an output-side end hat.

13. The magnetron according to claim 12, wherein a dimension of an entire axial free length part which faces the plate-like vanes is 50% or more and 80% or less of the axial dimension of the plurality of plate-like vanes.

14. A high-frequency utilizing apparatus comprising the magnetron according to claim 12.

15. A magnetron comprising:

a cylindrical anode tube in which a plurality of plate-like vanes are radially disposed toward a central axis;

a cathode disposed on the central axis of the anode tube by a cathode supporting rod; and a pair of end hats provided in positions on the cathode supporting rod to sandwich the cathode in the axial direction, wherein a center of an electron emission part of the cathode along the axial direction is displaced from a center of the plurality of plate-like vanes along the axial direction, an input-side end hat of the pair of end hats is configured such that a boss with a reduced outer diameter extends towards an interaction space, a smaller-diameter boss having a smaller diameter than the boss is formed with a step at the tip of the boss, the smaller-diameter boss of the input-side end hat and one end of a filament constituting the cathode are secured to each other, and the other end of the filament is secured to a boss of an output-side end hat.

16. The magnetron according to claim 15, wherein a dimension of the entire axial free length part which faces the plate-like vanes is 50% or more and 80% or less of the axial dimension of the plate-like vanes.

17. The magnetron according to claim 15, wherein the boss of the input-side end hat extends in a tapered shape with a reduced diameter towards the interaction space.

18. A high-frequency utilizing apparatus comprising the magnetron according to any one of claims 15 to 17.

* * * * *